US010539114B2

(12) United States Patent
Hayashi et al.

(10) Patent No.: US 10,539,114 B2
(45) **Date of Patent: *Jan. 21, 2020**

(54) IGNITION APPARATUS

(71) Applicant: DENSO CORPORATION, Kariya, Aichi-pref. (JP)

(72) Inventors: Naoto Hayashi, Kariya (JP); Makoto Toriyama, Kariya (JP); Kaori Doi, Kariya (JP); Kanechiyo Terada, Kariya (JP); Kenta Kyouda, Kariya (JP); Satoru Nakayama, Kariya (JP)

(73) Assignee: DENSO CORPORATION, Kariya (JP)

( * ) Notice: Subject to any disclaimer, the term of this patent is extended or adjusted under 35 U.S.C. 154(b) by 10 days.

This patent is subject to a terminal disclaimer.

(21) Appl. No.: 15/900,841

(22) Filed: Feb. 21, 2018

(65) Prior Publication Data

US 2018/0180014 A1 Jun. 28, 2018

Related U.S. Application Data

(62) Division of application No. 15/302,540, filed as application No. PCT/JP2015/060891 on Apr. 7, 2015, now Pat. No. 9,932,955.

(30) Foreign Application Priority Data

Apr. 10, 2014 (JP) ..... 2014-080669
Apr. 10, 2014 (JP) ..... 2014-080679

(51) Int. Cl.
*F02P 3/045* (2006.01)
*F02P 3/08* (2006.01)
(Continued)

(52) U.S. Cl.
CPC ..... *F02P 3/045* (2013.01); *F02P 3/0876* (2013.01); *F02P 9/00* (2013.01); *F02P 9/002* (2013.01);
(Continued)

(58) Field of Classification Search
CPC .. F02P 3/045; F02P 3/596; F02P 3/655; F02P 9/00; F02P 9/007; F02P 9/002; F02P 15/08; F02P 15/10; F02P 15/15
(Continued)

(56) References Cited

U.S. PATENT DOCUMENTS

2011/0247598 A1 10/2011 Tanaya
2012/0186569 A1 7/2012 Shimakawa et al.
(Continued)

FOREIGN PATENT DOCUMENTS

JP 60-156977 8/1985
JP H02-020466 6/1990
(Continued)

*Primary Examiner* — Mahmoud Gimie
(74) *Attorney, Agent, or Firm* — Nixon & Vanderhye P.C.

(57) ABSTRACT

An ignition apparatus inputs energy during a predetermined energy input period after the interruption of a primary electric current by an ignition switch and a discharge of an ignition plug caused by a secondary electric current. Moreover, the ignition apparatus includes a blow-off detection unit that detects, during the energy input period IGW after the start of the discharge by the ignition plug, occurrence of blow-off of the discharge. When the secondary electric current I2 drops below a blow-off detection electric current threshold value Ibo at a time instant tbo in a "second region" where it is impossible to perform a re-discharge after blow-off, the blow-off detection unit determines that blow-off has occurred and the ignition apparatus stops the energy input from an energy input unit to an ignition coil. By preventing unnecessary energy input, it is possible to suppress unnecessary electric power consumption and wear of electrodes of the ignition plug.

5 Claims, 11 Drawing Sheets

(51) Int. Cl.

| | |
|---|---|
| ***F02P 15/10*** | (2006.01) |
| ***F02P 9/00*** | (2006.01) |
| ***F02P 15/08*** | (2006.01) |
| *F02P 5/15* | (2006.01) |

(52) U.S. Cl.
CPC ..... *F02P 9/007* (2013.01); *F02P 15/08* (2013.01); *F02P 15/10* (2013.01); *F02P 5/15* (2013.01)

(58) Field of Classification Search
USPC ..... 123/609, 596, 655
See application file for complete search history.

(56) References Cited

U.S. PATENT DOCUMENTS

| | | | |
|---|---|---|---|
| 2013/0192570 | A1 | 8/2013 | Kajita et al. |
| 2016/0061177 | A1 | 3/2016 | Ishitani et al. |
| 2017/0022957 | A1 | 1/2017 | Hayashi et al. |
| 2017/0122281 | A1 | 5/2017 | Imanaka |

FOREIGN PATENT DOCUMENTS

| | | |
|---|---|---|
| JP | H07-229461 | 8/1995 |
| JP | 2001-32758 | 2/2001 |
| JP | 2003-074452 | 3/2003 |
| JP | 2007-120374 | 5/2007 |
| JP | 2008-088948 | 4/2008 |
| JP | 2010-65548 | 3/2010 |
| JP | 2010-065549 | 3/2010 |
| JP | 2013-83205 | 5/2013 |
| JP | 2015-200254 | 11/2015 |
| JP | 2015-200256 | 11/2015 |
| JP | 2015-200300 | 11/2015 |

(a)

(b)

IGNITION APPARATUS

This is a divisional of U.S. application Ser. No. 15/302,540, filed Oct. 7, 2016, which is the U.S. national phase of International Application No. PCT/JP2015/060891 filed Apr. 7, 2015 which designated the U.S. and claims priority to JP Patent Application No. 2014-080669 filed Apr. 10, 2014 and JP Patent Application No. 2014-080679 filed Apr. 10, 2014, the entire contents of each of which are hereby incorporated by reference.

TECHNICAL FIELD

The present invention relates to ignition apparatuses that control operation of ignition plugs.

BACKGROUND ART

Conventionally, there have been known ignition apparatuses for internal combustion engines which cause a discharge to occur between electrodes of an ignition plug, thereby igniting an air-fuel mixture. Moreover, in recent years, for lean-burn internal combustion engines designed to improve fuel economy, there have been developed techniques of creating a strong gas flow in a combustion chamber and thereby improving the combustibility. In such internal combustion engines, the discharge is extended by the gas flow, thereby improving the performance of igniting the air-fuel mixture. However, when the gas flow is strong, blow-off of the discharge may occur, immediately after which a re-discharge occurs. Further, after the re-discharge, a phenomenon is repeated in which the discharge is again blown off by the gas flow. Therefore, there is a problem that the electrodes of the ignition plug are worn down.

Accordingly, an ignition apparatus disclosed in, for example, Patent Document 1 inhibits a re-discharge after occurrence of blow-off, thereby preventing occurrence of the discharge repetition phenomenon and thus suppressing wear of the ignition plug electrodes.

PRIOR ART LITERATURE

Patent Literature

[PATENT DOCUMENT 1] Japanese Patent Application Publication No. JP2013100811A

SUMMARY OF THE INVENTION

Problems to be Solved by the Invention

According to the conventional technique of Patent Document 1, a re-discharge is inhibited whenever blow-off occurs. Therefore, when the air-fuel mixture has not been ignited before occurrence of blow-off, a misfire may be directly caused.

Moreover, with the conventional technique of Patent Document 1, it is impossible to suppress occurrence of blow-off itself. Furthermore, occurrence of blow-off is related not only with the operating condition of the internal combustion engine and the strength of the gas flow in the combustion chamber, but also with the combustion state which depends on differences between individual internal combustion engines, variation among cylinders and age deterioration. Therefore, the situation of occurrence of blow-off is not always the same. Hence, it is critical to suppress blow-off, without consuming extra energy, according to the situation of occurrence of blow-off.

The present invention has been made in view of the above problems. A first object of the present invention is to provide an ignition apparatus which appropriately determines the permissibility of a re-discharge according to the timing of occurrence of blow-off. Moreover, a second object of the present invention is to provide an ignition apparatus which can suppress blow-off after a re-discharge, without unnecessary energy consumption, according to the situation of occurrence of blow-off.

Means for Solving the Problems

The present invention provides a first ignition apparatus that controls operation of an ignition plug for igniting an air-fuel mixture in a combustion chamber of an internal combustion engine. The first ignition apparatus includes an ignition coil, an ignition switch, an energy input means and a blow-off detection means.

The ignition coil includes a primary coil in which a primary electric current supplied from a DC power supply flows, and a secondary coil which is connected to an electrode of the ignition plug and in which a secondary voltage is generated by supply and interruption of the primary electric current, more specifically by interruption following supply of the primary electric current, and thus a secondary electric current flows.

The ignition switch is connected to a ground side of the primary coil and switches the supply and interruption of the primary electric current according to an ignition signal; the ground side is an opposite side of the primary coil to the DC power supply.

The energy input means is capable of inputting energy during a predetermined energy input period (IGW) after the interruption of the primary electric current by the ignition switch and a discharge of the ignition plug caused by the secondary voltage due to the interruption. Preferably, the energy input means is capable of inputting energy from the ground side of the primary coil in the same polarity as the secondary electric current and in a superimposing manner.

The blow-off detection means detects occurrence of blow-off of the discharge after the start of the discharge by the ignition plug. Here, "detection" is not limited to a direct detection, but also encompasses an indirect estimation based on information about blow-off.

The first ignition apparatus of the present invention is characterized by stopping the energy input by the energy input means when occurrence of blow-off is detected by the blow-off detection means in a "second region" after a "first region"; the first region is a time region from the start of the energy input period and in which a re-discharge after blow-off of the ignition plug is possible.

That is, in the first ignition apparatus of the present invention, the energy input period is divided into the "first region" from the start to a predetermined shift time and a "second region" from the shift time to the end. In the first region, a relatively large amount of the inductive energy of the ignition coil remains; therefore, a re-discharge after blow-off of the ignition plug is possible. On the other hand, in the second region, most of the inductive energy of the ignition coil has been consumed; therefore, even if energy is inputted from the primary coil, it is impossible to perform a discharge since the secondary voltage is low and thus impossible to perform a re-discharge after blow-of.

Accordingly, when occurrence of blow-off is detected in the second region, the energy input by the energy input means is stopped, thereby preventing unnecessary energy input. Consequently, it is possible to suppress unnecessary electric power consumption and wear of the ignition plug electrodes.

It is preferable that when occurrence of blow-off is detected in the first region, the energy input by the energy input means is continued.

Consequently, during a time period where a re-discharge after blow-off is possible, the energy supply to the air-fuel mixture is continued by actively performing a re-discharge. That is, when blow-off has occurred in the first region, the securing of the ignition performance is given priority over the suppression of wear of the ignition plug electrode.

As above, it is possible to appropriately determine the permissibility of a re-discharge according to the timing of occurrence of blow-off, thereby securing the ignition performance while suppressing wear of the ignition plug electrodes.

Furthermore, the first ignition apparatus of the present invention further includes a secondary electric current detection means that detects the secondary electric current during the energy input period. It is preferable that when the absolute value of the secondary electric current drops below a predetermined blow-off detection electric current threshold value, the blow-off detection means determines that blow-off has occurred. That is, the absolute value of the secondary electric current rapidly drops upon occurrence of blow-off; therefore, it is possible to appropriately detect occurrence of blow-off by monitoring the absolute value of the secondary electric current.

Moreover, with the secondary electric current detection means, it is possible to improve the controllability of the secondary electric current by a feedback control based on the detected electric current.

Moreover, the present invention also provides a second ignition apparatus that controls operation of an ignition plug for igniting an air-fuel mixture in a combustion chamber of an internal combustion engine. The second ignition apparatus includes an ignition coil, an ignition switch, an energy input means, an input energy control means and a blow-off detection means.

The ignition coil includes a primary coil in which a primary electric current supplied from a DC power supply flows, and a secondary coil which is connected to an electrode of the ignition plug, to which a secondary voltage generated by supply and interruption of the primary electric current is applied and in which a secondary electric current caused by a discharge flows.

The ignition switch is connected to a ground side of the primary coil and switches the supply and interruption of the primary electric current according to an ignition signal; the ground side is an opposite side of the primary coil to the DC power supply.

The energy input means is capable of inputting energy during a predetermined energy input period after the interruption of the primary electric current by the ignition switch and a discharge of the ignition plug caused by the voltage due to the interruption.

The input energy control means controls an energy input quantity inputted by the energy input means based on a control value.

The blow-off detection means detects, after the start of the discharge by the ignition plug, occurrence of the so-called "blow-off" which is a phenomenon where the discharge state is interrupted.

Further, when blow-off has been detected a predetermined number of times during the energy input period, the input energy control means increases the energy input quantity.

In the second ignition apparatus of the present invention, the energy input quantity is increased according to the situation of occurrence of blow-off. Consequently, it is possible to suppress blow-off after a re-discharge, without unnecessary energy consumption.

BRIEF DESCRIPTION OF THE DRAWINGS

FIG. 6(*b*) is a map showing the relationship between engine rotational speed and the duration of the first region.

EMBODIMENTS FOR CARRYING OUT THE INVENTION

Hereinafter, embodiments of the present invention will be described with reference to the drawings.

First Embodiment

An ignition apparatus according to a first embodiment of the present invention is applied to an engine system installed in a vehicle or the like. In the explanation given hereinafter, the "internal combustion engine" recited in the claims will be referred to as the "engine".

Figure 1:
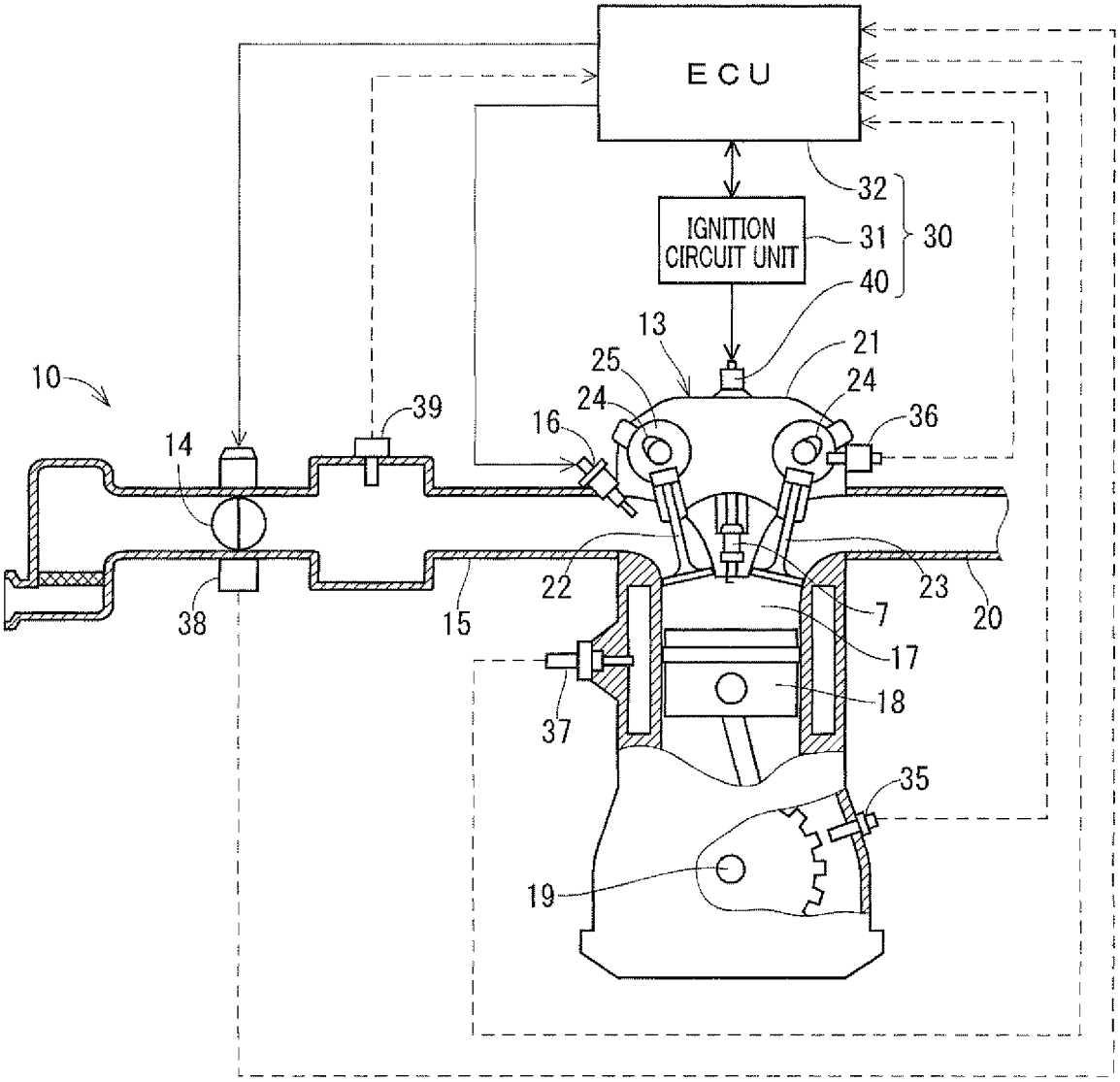
FIG. 1 is a schematic configuration diagram of an engine system to which an ignition apparatus according to a first embodiment of the present invention is applied.

First, the schematic configuration of the engine system will be described with reference to FIG. 1. As shown in FIG. 1, the engine system 10 includes a spark ignition-type engine 13. The engine 13 is a multi-cylinder engine such as a four-cylinder engine. In FIG. 1, there is shown a cross section of only one cylinder. The configuration described hereinafter is provided similarly in the other cylinders not shown in the figure.

In addition, the engine system 10 of FIG. 1 includes no EGR (Exhaust Gas Recirculation) system. Alternatively, in the case of the engine system 10 including an EGR system, the EGR system is not shown in the figure since it is less relevant to the characteristics of the ignition apparatus of the present embodiment. Moreover, a catalyst provided in an exhaust passage is also not shown in the figure.

The engine 13 causes an air-fuel mixture, which is a mixture of air supplied from an intake manifold 15 via a throttle valve 14 and fuel injected by an injector 16, to be combusted in a combustion chamber 17, thereby reciprocating a piston 18 with the explosive power created by the combustion of the air-fuel mixture. The reciprocating motion of the piston 18 is outputted after being converted into a rotational motion by a crankshaft 19. The combustion gas is emitted to the atmosphere via an exhaust manifold 20 and the like.

An intake valve 22 is provided in an intake port of a cylinder head 21; the intake port is an entrance of the combustion chamber 17. Moreover, an exhaust valve 23 is provided in an exhaust port of the cylinder head 21; the exhaust port is an exit of the combustion chamber 17. The intake valve 22 and the exhaust valve 23 are open/close driven by a valve drive mechanism 24. The valve timing of the intake valve 22 is adjusted by a variable valve mechanism 25.

The ignition of the air-fuel mixture in the combustion chamber 17 is performed by causing a discharge between electrodes of an ignition plug 7 by an ignition apparatus 30. Based on a command of an electronic control unit 32, the ignition apparatus 30 causes an ignition circuit unit 31 to operate to apply a high voltage to the ignition plug 7 from an ignition coil 40, thereby causing a spark discharge to occur in the combustion chamber 17.

The ignition plug 7 has a pair of electrodes (see FIG. 2) opposed to face each other through a predetermined gap in the combustion chamber 17 of the engine 13. When a voltage high enough to cause dielectric breakdown to occur in the gap is applied to the pair of electrodes, a discharge occurs. In the explanation given hereinafter, "high voltage" denotes a voltage high enough to cause a discharge to occur between the pair of electrodes of the ignition plug 7.

The electronic control unit 32 is constituted of a microcomputer which includes a CPU, a ROM, a RAM, input/output ports and the like. The electronic control unit 32 is denoted by "ECU" in the figures.

As shown with dashed-line arrows, to the electronic control unit 32, there are inputted detection signals from various sensors such as a crank angle sensor 35, a cam position sensor 36, a water temperature sensor 37, a throttle position sensor 38 and an intake pressure sensor 39. Based on the detection signals from the various sensors, the electronic control unit 32 drives the throttle valve 14, the injector 16, the ignition circuit unit 31 and the like, as shown with continuous-line arrows, thereby controlling the operating state of the engine 13.

Next, the configuration of the ignition apparatus 30 according to the present embodiment will be described with reference to FIG. 2.

Figure 2:
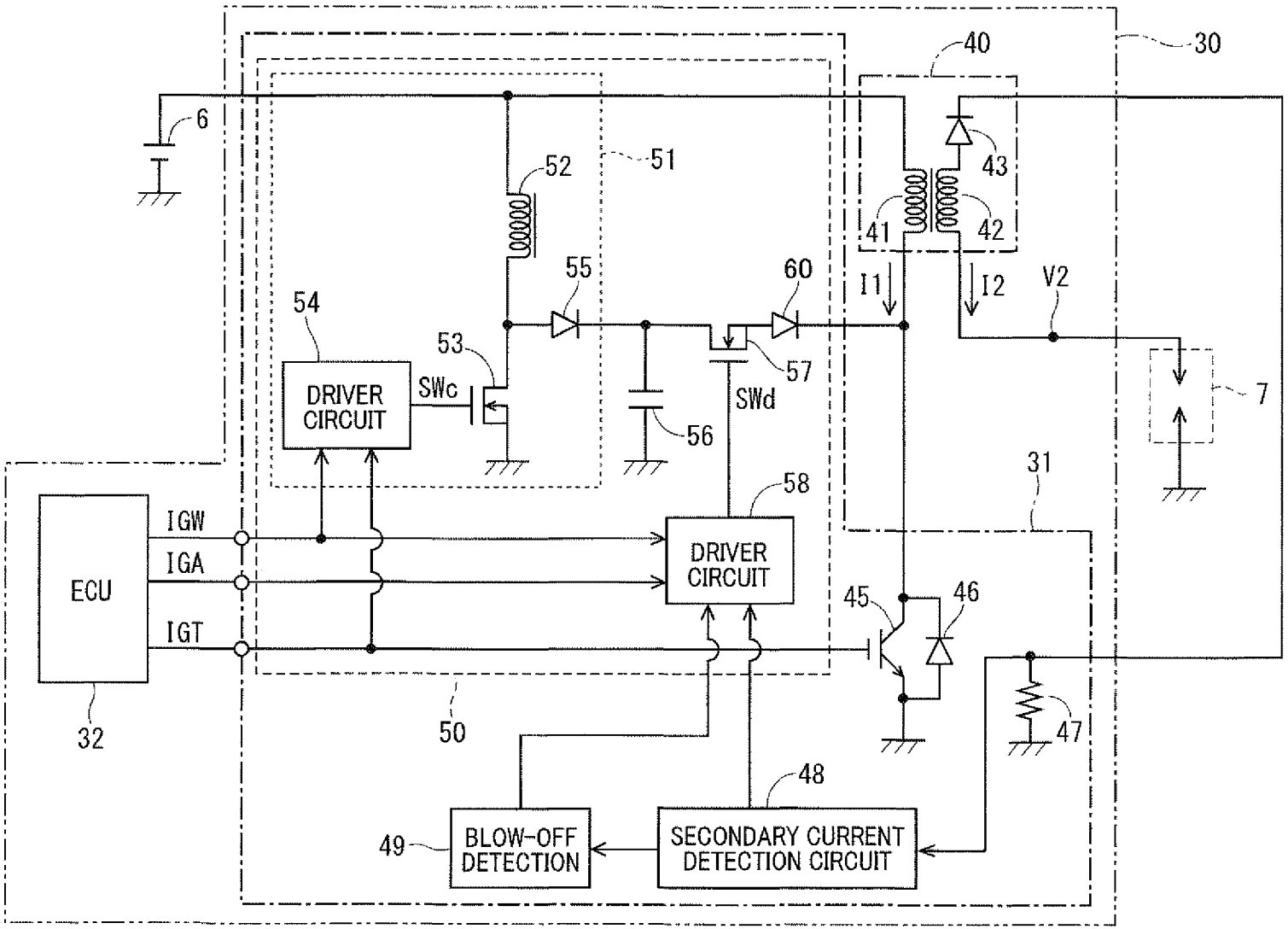
FIG. 2 is a configuration diagram of the ignition apparatus according to the first embodiment of the present invention.

As shown in FIG. 2, the ignition apparatus 30 includes the ignition coil 40, the ignition circuit unit 31 and the electronic control unit 32.

The ignition coil 40 includes a primary coil 41, a secondary coil 42 and a rectifying element 43. The ignition coil 40 constitutes a publicly-known booster transformer.

The primary coil 41 has one end connected to a positive terminal of a battery 6 which is a "DC power supply" capable of supplying a constant DC voltage, and the other end grounded via an ignition switch 45. Hereinafter, the opposite side of the primary coil 41 to the battery 6 will be referred to as "ground side". The secondary coil 42 is magnetically coupled with the primary coil 41. The secondary coil 42 has one end grounded via the pair of electrodes of the ignition plug 7 and the other end grounded via the rectifying element 43 and a secondary electric current detection resistor 47.

The electric current flowing in the primary coil 41 will be referred to as primary electric current I1. The electric current which is generated by supply and interruption of the primary electric current I1 and flows in the secondary coil 42 will be referred to as secondary electric current I2. As shown with arrows in the figure, the primary electric current I1 is defined to be positive when flowing in the direction from the primary coil 41 to the ignition switch 45; the secondary electric current I2 is defined to be positive when flowing in the direction from the secondary coil 42 to the ignition plug 7. Moreover, the voltage on the ignition plug 7 side of the secondary coil 42 will be referred to as secondary voltage V2.

The rectifying element 43 is constituted of a diode. The rectifying element 43 rectifies the secondary electric current I2.

The ignition coil 40 generates a high voltage in the secondary coil 42 by the mutual inductive action of electromagnetic induction according to change in the electric current flowing in the primary coil 41, and applies the high voltage to the ignition plug 7. In the present embodiment, one ignition coil 40 is provided per ignition plug 7.

The ignition circuit unit 31 includes the ignition switch (igniter) 45, an energy input unit 50, the secondary electric current detection resistor 47 and a secondary electric current detection circuit 48. Moreover, the ignition circuit unit 31 includes a blow-off detection unit 49 which is a characteristic configuration of the present invention.

The ignition switch 45 is constituted, for example, of an IGBT (Insulated Gate Bipolar Transistor). The ignition switch 45 has its collector connected to the ground side of the primary coil 41 of the ignition coil 40, its emitter grounded and its gate connected to the electronic control unit 32. The emitter is connected to the collector via a rectifying element 46.

The ignition switch 45 is on/off operated according to an ignition signal IGT inputted to the gate. Specifically, the ignition switch 45 is turned on when the ignition signal IGT rises and off when the ignition signal IGT falls. The supply and interruption of the primary electric current I1 flowing in the primary coil 41 is switched by the ignition switch 45 according to the ignition signal IGT.

The energy input unit 50, as an "energy input means", includes a DC-to-DC converter 51, a capacitor 56, a discharge switch 57, a discharge switch driver circuit 58 and a rectifying element 60. The DC-to-DC converter 51 is configured with an energy storage coil 52, a charge switch 53, a charge switch driver circuit 54 and a rectifying element 55. The energy input unit 50 continuously inputs energy to the ground side of the primary coil 41.

The DC-to-DC converter 51 boosts the voltage of the battery 6 and supplies it to the capacitor 56.

The energy storage coil 52 has one end connected to the battery 6 and the other end grounded via the charge switch 53. The charge switch 53 is constituted, for example, of a MOSFET (Metal Oxide Semiconductor Field Effect Transistor). The charge switch 53 has its drain connected to the energy storage coil 52, its source grounded and its gate connected to the charge switch driver circuit 54. The charge switch driver circuit 54 is capable of on/off driving the charge switch 53.

The rectifying element 55 is constituted of a diode. The rectifying element 55 prevents electric current from flowing from the capacitor 56 back to the side of the energy storage coil 52 and the charge switch 53.

Upon the charge switch 53 being turned on, induced electric current flows in the energy storage coil 52 and thus electrical energy is stored therein. Moreover, upon the charge switch 53 being turned off, the electrical energy stored in the energy storage coil 52 is superimposed on the DC voltage of the battery 6 and discharged to the capacitor 56 side. With the repeated on/off operation of the charge switch 53, the storage and discharge of energy is repeated in the energy storage coil 52, thereby boosting the battery voltage.

The capacitor 56 has one electrode connected to the ground side of the energy storage coil 52 via the rectifying element 55 and the other electrode grounded. The capacitor 56 stores the voltage boosted by the DC-to-DC converter 51.

The discharge switch 57 is constituted, for example, of a MOSFET. The discharge switch 57 has its drain connected to the capacitor 56, its source connected to the ground side of the primary coil 41 and its gate connected to the discharge switch driver circuit 58. The discharge switch driver circuit 58 is capable of on/off driving the discharge switch 57.

The rectifying element 60 is constituted of a diode. The rectifying element 60 prevents electric current from flowing from the ignition coil 40 back to the capacitor 56.

In addition, in FIG. 2, there is shown only the configuration for one cylinder. However, in practice, the configuration after the discharge switch 57 is provided for each of the cylinders in parallel; the electric current path is branched to each cylinder before the discharge switch 57; and the energy stored in the capacitor 56 is distributed to each path.

The secondary electric current detection circuit 48 detects the secondary electric current I2 based on the voltage between two ends of the secondary electric current detection resistor 47 provided in the combustion chamber 17. Moreover, by a feedback control for bringing the secondary electric current I2 into agreement with a target value (to be referred to as "target secondary electric current I2*" hereinafter), the secondary electric current detection circuit 48 calculates an on-duty ratio of the discharge switch 57 and commands it to the discharge switch driver circuit 58.

The blow-off detection unit 49, as a "blow-off detection means", detects that after the start of a discharge by the ignition plug 7, blow-off of the discharge has occurred due to the gas flow created in the combustion chamber 17. More particularly, in the present embodiment, the blow-off detection unit 49 detects occurrence of blow-off based on the value of the secondary electric current I2 detected by the secondary electric current detection circuit 48. The operation when occurrence of blow-off has been detected will be described later.

The above is the configuration of the ignition circuit unit 31.

Next, the electronic control unit 32 generates, based on the operating information of the engine 13 acquired from the various sensors such as the crank angle sensor 35, the ignition signal IGT and an energy input period signal IGW and outputs them to the ignition circuit unit 31.

The ignition signal IGT is inputted to the gate of the ignition switch 45 and the charge switch driver circuit 54. The ignition switch 45 is kept on for a time period for which the ignition signal IGT is inputted. The charge switch driver circuit 54 repeatedly outputs, for the time period for which the ignition signal IGT is inputted, a charge switch signal SWc for on/off controlling the charge switch 53 to the gate of the charge switch 53.

The energy input period signal IGW is inputted to the discharge switch driver circuit 58. The discharge switch driver circuit 58 repeatedly outputs, for a time period for which the energy input period signal IGW is inputted, a discharge switch signal SWd for on/off controlling the discharge switch 57 to the gate of the discharge switch 57.

Moreover, to the discharge switch driver circuit 58, there is also inputted a target secondary electric current signal IGA for commanding the target secondary electric current I2*.

Next, the operation of the ignition apparatus 30 according to the present embodiment will be described with reference to the time chart of FIG. 3. The time chart of FIG. 3 shows, with the lateral axis being a common time axis, the changes with time of the ignition signal IGT, the energy input period signal IGW, a capacitor voltage Vdc, the primary electric current I1, the secondary electric current I2, an input energy P, the charge switch signal SWc and the discharge switch signal SWd on the vertical axis sequentially from the upper side.

Here, the "capacitor voltage Vdc" denotes the voltage stored in the capacitor 56. Moreover, the "input energy P" denotes the energy which is discharged from the capacitor 56 and supplied to the ignition coil 40 from a low voltage-side terminal of the primary coil 41; the "input energy P" indicates an integrated value from the supply start (the first rising of the discharge switch signal SWd) for one ignition timing.

Figure 3:
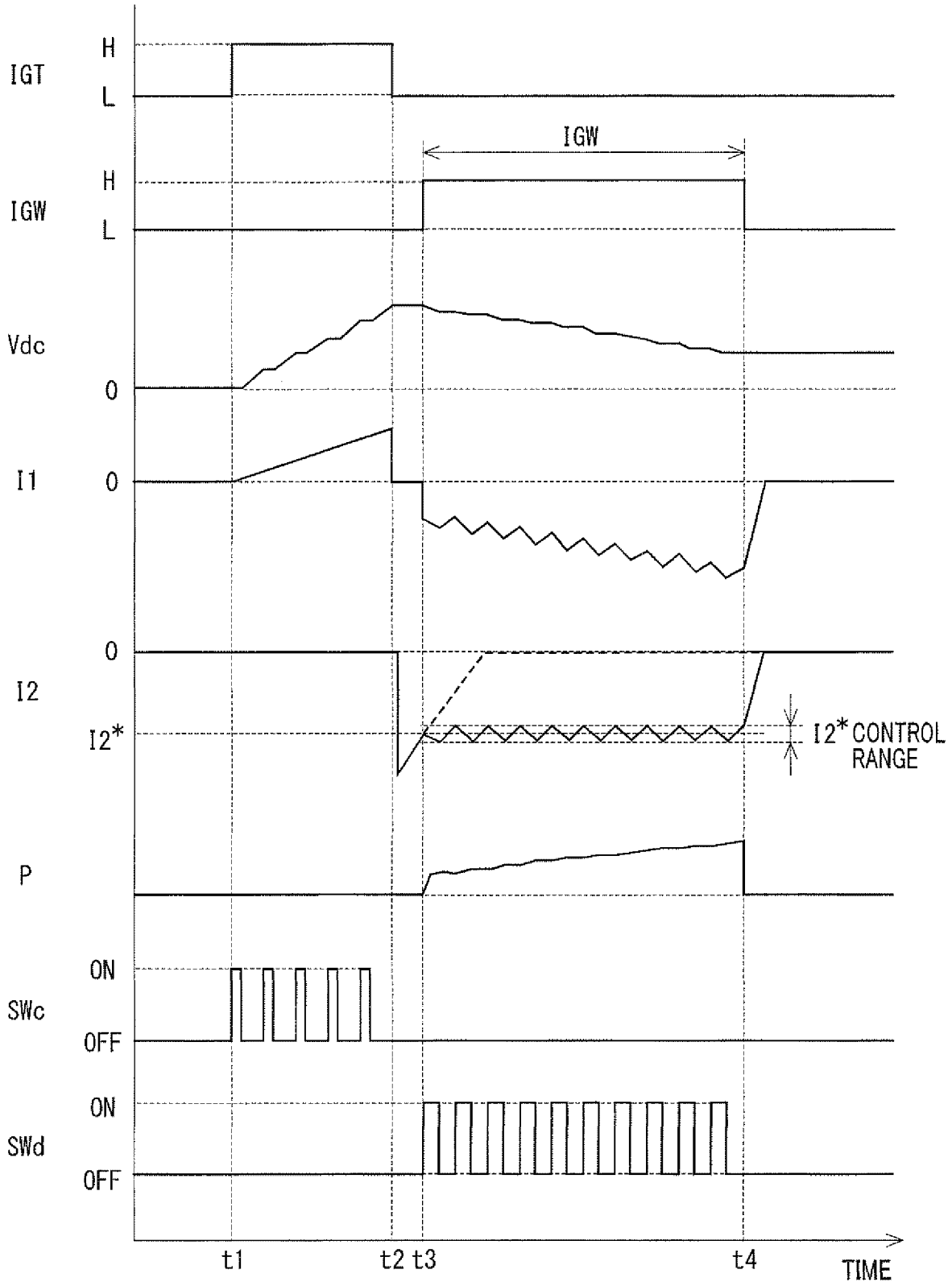
FIG. 3 is a time chart illustrating the basic operation of the ignition apparatus of FIG. 2.

In FIG. 3, "primary electric current I1" and "secondary electric current I2" are defined to be positive when flowing in the directions of arrows shown in FIG. 2 and negative when flowing in the opposite directions to the arrows. In the explanation given hereinafter, when the magnitude of a negative electric current is mentioned, the magnitude is indicated based on "the absolute value of the electric current". That is, in a negative region, when the electric current value moves away from 0 (A) and thus the absolute value increases, it is expressed as "the electric current increases or rises"; when the electric current value approaches 0 (A) and thus the absolute value decreases, it is expressed as "the electric current decreases or drops". Furthermore, in the comparison of the secondary electric current I2 with a negative threshold value in FIGS. 4 and 5 to be described later, "the secondary electric current I2 drops below the threshold value" denotes "the absolute value of the secondary electric current I2 drops below the threshold value".

Moreover, the time period from a time instant t3 to a time instant t4, for which the energy input period signal IGW is outputted, is expressed as "energy input period IGW" using the same reference sign. The control target value of the secondary electric current I2 for the energy input period IGW is expressed as "target secondary electric current I2*". The target secondary electric current I2* is set to an electric current value with which it is possible to maintain an ignition discharge well.

The secondary electric current I2 has a waveform that repeats increasing and decreasing within a control range whose middle value is set to the target secondary electric current I2*. Though the target secondary electric current value I2* is shown as the middle value of the control range in FIG. 3, it is also possible to set the control target value to a maximum value or a minimum value of the control range.

Upon the rising of the ignition signal IGT to a H (High) level at a time instant t1, the ignition switch 45 is turned on. At this time, since the energy input period signal IGW is at a L (Low) level, the discharge switch 57 is kept off. Consequently, supply of the primary electric current I1 to the primary coil 41 is started.

Moreover, during the time period for which the ignition signal IGT is kept at the H level, the charge switch signal SWc in the form of a rectangular-wave pulse is inputted to the gate of the charge switch 53. Then, the capacitor voltage Vdc rises stepwise during each off-period after one on-period of the charge switch 53.

In this way, during the time period from the time instant t1 to a time instant t2, for which the ignition signal IGT is kept at the H level, the ignition coil 40 is charged and energy is stored in the capacitor 56 by the output of the DC-to-DC converter 51. The storage of energy is ended until the time instant t2.

At this time, the capacitor voltage Vdc, i.e., the energy storage quantity in the capacitor 56 can be controlled by the on-duty ratio and the number of times of on/off switching of the charge switch signal SWc.

Thereafter, when the ignition signal IGT is lowered to the L level at the time instant t2 and thus the ignition switch 45 is turned off, the primary electric current I1 having been supplied to the primary coil 41 is suddenly interrupted. Then, a high voltage is generated in the secondary coil 42 and a discharge occurs between the electrodes of the ignition plug 7, thereby causing the secondary electric current (discharge current) to flow.

In the case where no energy input is performed after causing the ignition discharge at the time instant t2, the secondary electric current I2 approaches 0 (A) with the elapse of time, as shown with a dashed line. The discharge is ended when the secondary electric current I2 has attenuated to such a degree that it is impossible to sustain the discharge. The ignition method by such a discharge will be referred to as "normal ignition".

In comparison, in the present embodiment, the energy input period signal IGW is raised to the H level at the time instant t3 immediately after the time instant t2, and the discharge switch 57 is turned on with the charge switch 53 kept off. Then, the stored energy of the capacitor 56 is discharged and inputted to the ground side of the primary coil 41. Consequently, during the ignition discharge, "the primary electric current I1 caused by the input energy P" is supplied. In addition, the higher the capacitor voltage Vdc having been stored until the time instant t2, the larger the input energy P.

At this time, in the secondary coil 42, on the secondary electric current I2 supplied during the time period between the time instants t2 and t3, there is superimposed in the same polarity an additional secondary electric current I2 which is generated with the supply of the primary electric current I1 caused by the input energy P. The superimposition of the primary electric current I1 is performed each time the discharge switch 57 is turned on during the time period from the time instant t3 to the time instant t4.

That is, each time the discharge switch signal SWd is switched on, the primary electric current I1 is successively increased by the stored energy of the capacitor 56. In response to the successive increase of the primary electric current I1, the secondary electric current I2 is also successively increased. When the secondary electric current I2 has been increased to a predetermined value, the discharge switch 57 is turned off and thus the superimposing input to the primary electric current I1 is stopped. Then, when I2 has been decreased to a predetermined value, the discharge switch 57 is again turned on. Consequently, the secondary electric current I2 is kept in agreement with the target secondary electric current I2*.

Upon the energy input period signal IGW being lowered to the L level at the time instant t4, the on/off operation of the discharge switch signal SWd is stopped and both the primary electric current I1 and the secondary electric current I2 become zero.

The control method of inputting energy to the ignition coil 40 from "the ground side of the primary coil 41" after the ignition discharge at the time instant t2 has been developed by the present applicant. Hereinafter, in the present specification, "energy input control" denotes this control method.

On the other hand, methods of inputting energy to the ignition coil 40 from the battery 6 side of the primary coil 41 or from the opposite side of the secondary coil 42 to the ignition plug 7, such as a well-known multiple discharge method, will be comprehensively referred to as "conventional energy input controls". Compared to the conventional methods, in the energy input control developed by the present applicant, by inputting energy from the low-voltage side, it is possible to sustain an ignitable state for a given time period while efficiently inputting a minimum amount of energy.

Here, the ignition apparatus 30 of the present embodiment is assumed to be applied to a lean-burn engine that creates a strong gas flow in the combustion chamber 17 and thereby improves the combustibility. In such an engine, the discharge is extended by the gas flow, thereby improving the performance of igniting the air-fuel mixture. However, when the gas flow is strong, blow-off of the discharge may occur. Moreover, when an unnecessary re-discharge is performed after blow-off of the discharge, there is caused a problem that the electrodes of the ignition plug 7 are worn down.

Accordingly, the ignition apparatus 30 of the present embodiment includes the blow-off detection unit 49 that detects occurrence of blow-off based on the secondary electric current I2 detected by the secondary electric current detection circuit 48. Moreover, the ignition apparatus 30 of the present embodiment is characterized by determining, based on the timing of occurrence of blow-off, whether to continue the energy input and thereby cause a re-discharge or to stop the energy input and thereby inhibit a re-discharge.

Figure 4:
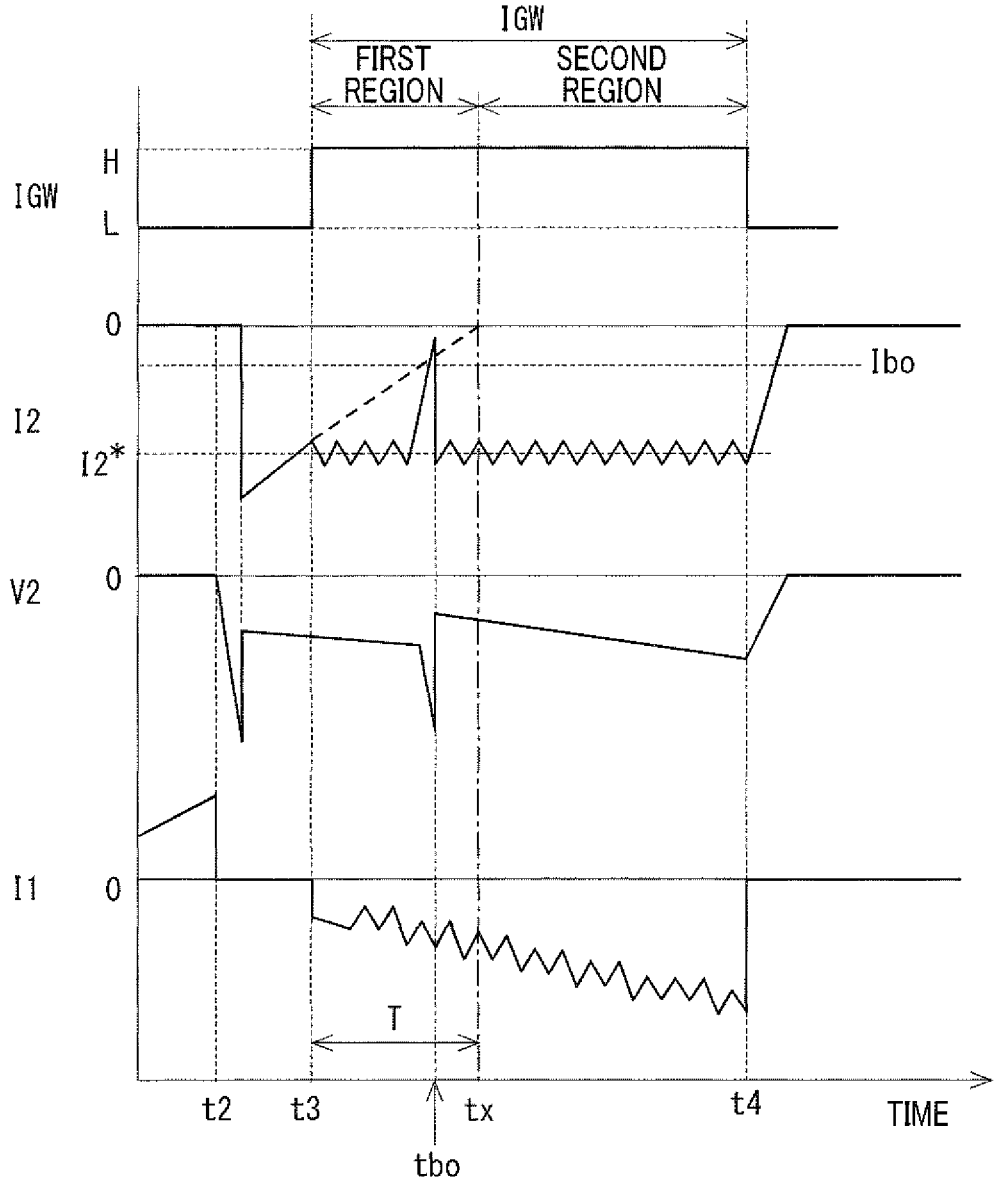
FIG. 4 is a time chart illustrating the operation when blow-off has occurred in a first region.
Figure 5:
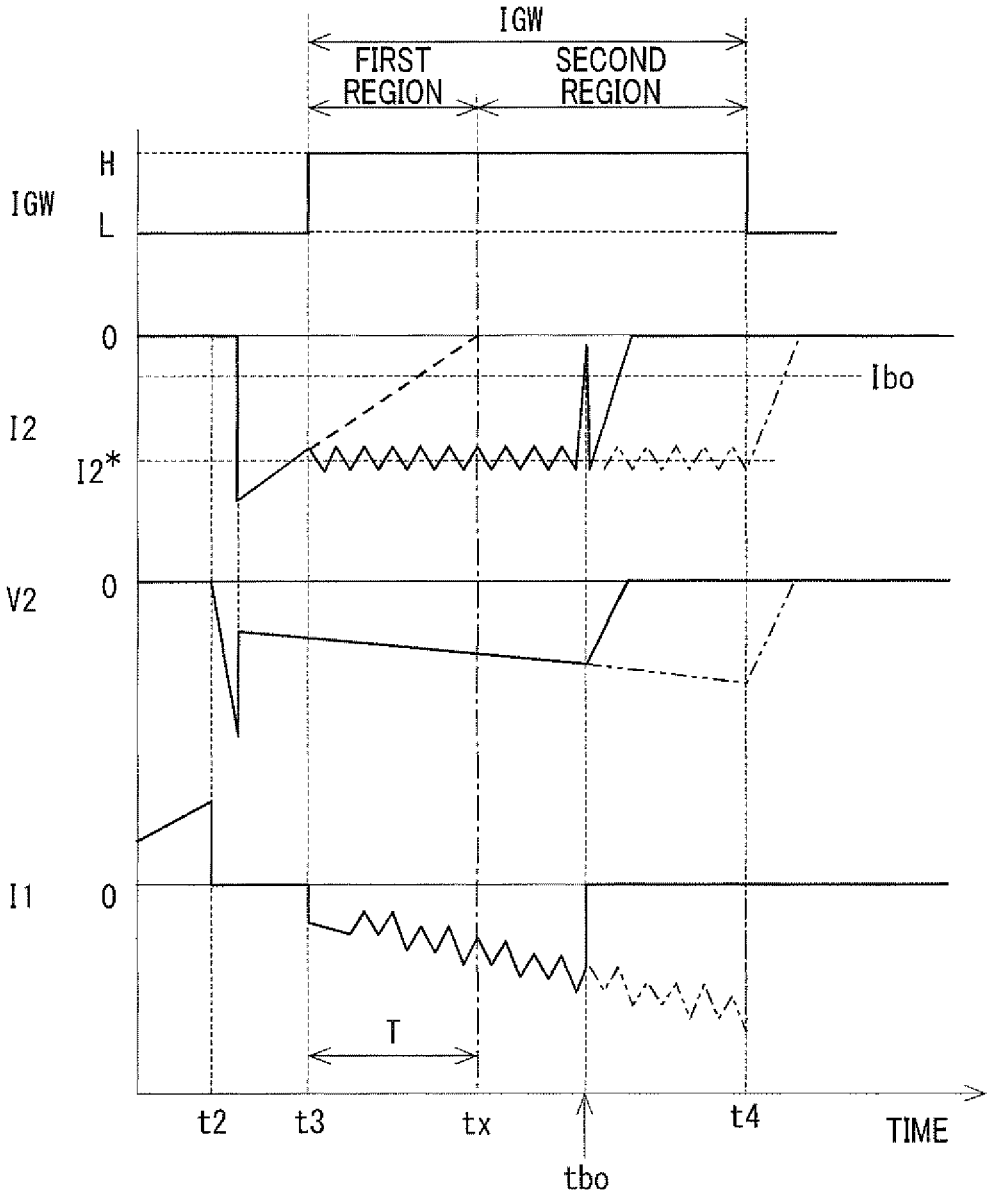
FIG. 5 is a time chart illustrating the operation when blow-off has occurred in a second region.

Next, the operation when blow-off of the discharge has occurred during the energy input period IGW will be described with reference to FIGS. 4 and 5. In FIGS. 4 and 5, the time instants t2, t3 and t4 on the lateral axis of the time chart are quoted from FIG. 3. Moreover, in FIGS. 4 and 5, the energy input period signal IGW, the secondary electric current I2, the secondary voltage V2 and the primary electric current I1 are shown on the vertical axis. In addition, in FIGS. 4 and 5, the secondary electric current I2 by the energy input is shown with a continuous line, while that by the normal ignition is shown with a dashed line.

Here, for illustrating the rising of the secondary electric current I2 at the timing where the discharge is started by the secondary voltage V2, the time interval between the time instants t2 and t3 is exaggeratedly shown in FIGS. 4 and 5 in comparison with that in FIG. 3.

As shown in FIGS. 4 and 5, the energy input period IGW is divided into two time regions, i.e., a "first region" from the start time instant t3 of the input period to a predetermined shift time instant tx and a "second region" from the shift time instant tx to the end time instant t4 of the input period.

In the first region, a relatively large amount of the inductive energy of the ignition coil 40 remains; therefore, a re-discharge after blow-off of the ignition plug 7 is possible. On the other hand, in the second region, most of the inductive energy of the ignition coil 40 has been consumed; therefore, even if energy is inputted, it is impossible to reach a high voltage and thus impossible to perform a re-discharge after blow-off.

As shown in FIG. 4, when the secondary electric current I2 drops below a blow-off detection electric current threshold value Ibo at a time instant tbo in the first region, the blow-off detection unit 49 determines that blow-off has occurred and maintains the operation of the discharge switch driver circuit 58. Consequently, the energy input from the energy input unit 50 to the ignition coil 40 is continued. At this time, since a relatively large amount of the inductive energy of the ignition coil 40 remains, the secondary voltage V2 instantaneously rises, causing a re-discharge of the ignition plug 7 to occur. Thus, during a time period where a re-discharge after blow-off is possible, a re-discharge is actively performed, thereby continuing the energy supply to the air-fuel mixture.

On the other hand, in FIG. 5, waveforms when no blow-off occurs are shown with two-dot chain lines, while waveforms when blow-off occurs are shown with continuous lines. When the secondary electric current I2 drops below the blow-off detection electric current threshold value Ibo at a time instant tbo in the second region, the blow-off detection unit 49 determines that blow-off has occurred and stops the operation of the discharge switch driver circuit 58. Consequently, the on/off operation of the discharge switch 57 is stopped; thus the energy input from the energy input unit 50 to the ignition coil 40 is also stopped.

In the second region, not enough inductive energy remains to perform a re-discharge after blow-off. Therefore, if the energy input was continued after occurrence of blow-off in such a state, unnecessary electric power consumption would be caused which however could not result in an ignition.

Accordingly, in the present embodiment, upon detection of occurrence of blow-off, the energy input from the energy input unit 50 is stopped, thereby preventing a re-discharge.

In addition, the blow-off detection electric current threshold value Ibo may be a fixed value or varied according to the operating condition of the engine 13.

Next, the setting of the duration T of the first region, i.e., the length T of time from the start time instant t3 of the energy input period IGW to the shift time instant tx will be described with reference to maps of FIG. 6.

Figure 6:
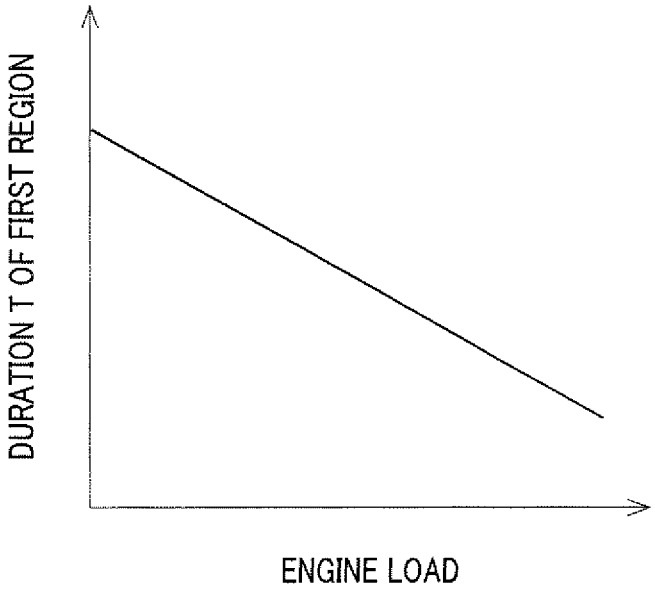
FIG. 6(*a*) is a map showing the relationship between engine load and the duration of the first region.
Figure 6:
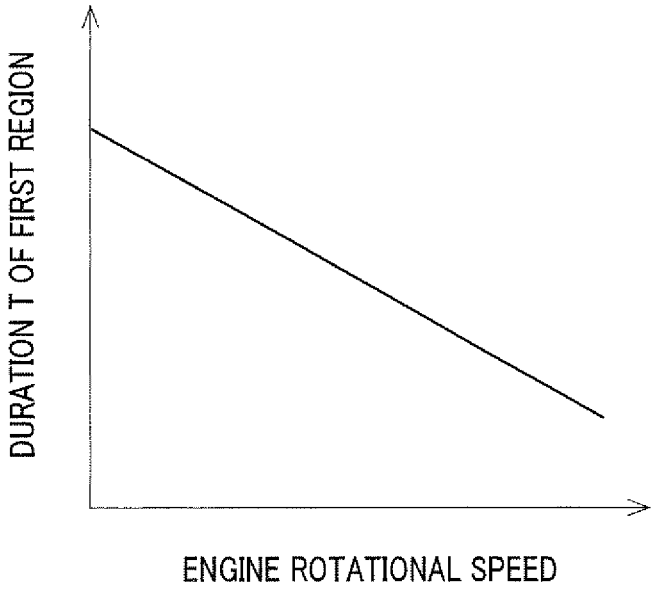

As shown in FIG. 6(*a*), the higher the engine load, the shorter the duration T of the first region is set. Moreover, as shown in FIG. 6(*b*), the higher the engine rotational speed, the shorter the duration T of the first region is set. This is because the higher the engine load or the engine rotational speed, the more energy remaining in the ignition coil 40 is required for a re-discharge and thus the shorter the time period, in which a re-discharge is possible after the start of the energy input, becomes.

In the ignition apparatus 30, the electronic control unit 32 may calculate an appropriate duration T of the first region based on the acquired information about the engine load and the engine rotational speed and change the shift time instant tx for the blow-off determination from, for example, the next combustion cycle.

In the first embodiment, it is possible to achieve the following advantageous effects.

(1) The ignition apparatus 30 of the first embodiment includes the blow-off detection unit 49 that detects, after the start of a discharge by the ignition plug 7, occurrence of blow-off of the discharge. When occurrence of blow-off is detected in the second region where it is impossible to perform a re-discharge after blow-off, the energy input by the energy input unit 50 is stopped. Consequently, it is possible to prevent unnecessary energy input, thereby suppressing unnecessary electric power consumption and wear of the ignition plug electrodes.

Moreover, when occurrence of blow-off is detected in the first region where it is possible to perform a re-discharge after blow-off, the energy input by the energy input unit 50 is continued. Thus, during a time period where a re-discharge after blow-off is possible, the ignition performance can be secured by actively performing a re-discharge and continuing the energy supply to the air-fuel mixture.

As above, it is possible to appropriately determine the permissibility of a re-discharge according to the timing of occurrence of blow-off, thereby securing the ignition performance while suppressing wear of the ignition plug electrodes.

(2) The ignition apparatus 30 of the first embodiment includes the secondary electric current detection circuit 48 that detects the secondary electric current I2 during the energy input period IGW. When the absolute value of the secondary electric current I2 drops below the predetermined blow-off detection electric current threshold value Ibo, the blow-off detection unit 49 determines that blow-off has occurred. That is, the absolute value of the secondary electric current I2 rapidly drops upon occurrence of blow-off; therefore, it is possible to appropriately detect occurrence of blow-off by monitoring the absolute value of the secondary electric current I2.

Moreover, with the secondary electric current detection resistor 47 and the secondary electric current detection circuit 48, it is possible to accurately bring the actual value of the secondary electric current I2 into agreement with the target secondary electric current I2* by the feedback control based on the detected electric current.

(3) In the ignition apparatus 30 of the first embodiment, as the energy input control method, there is used the method of inputting the input energy, which is boosted by the DC-to-DC converter 51 and stored in the capacitor 56, from the ground side of the primary coil 41. Consequently, compared to an energy input method such as multiple discharge, by inputting energy from the low-voltage side, it is possible to sustain an ignitable state for a given time period while efficiently inputting a minimum amount of energy.

Moreover, during the energy input period IGW, the secondary electric current I2 always takes a negative value and does not cross zero as in other methods that use alternating current; therefore, it is possible to prevent occurrence of blow-off.

Modifications of First Embodiment (1) The energy input unit 50 of the first embodiment uses the "method of inputting energy from the ground side of the primary coil", which has been developed by the present applicant. However, other methods, such as the conventional multiple discharge method or a "DCO method" disclosed in Japanese Patent Application Publication No. JP2012167665A, may also be used as the "energy input means" of the present invention provided that it is possible to stop the energy input during the energy input period.

Moreover, in the energy input method shown in FIG. 3, during the time period for which the ignition signal IGT is kept at the H level, the capacitor voltage Vdc is stored by switching on/off the charge switch signal SWc; then, during the energy input period IGW, energy is inputted to the ground side of the primary coil 41. However, the energy input control by the ignition apparatus 30 having the configuration of FIG. 2 is not limited to the energy input method shown in FIG. 3. For example, during the energy input period IGW, the charge switch signal SWc and the discharge switch signal SWd may be alternately on/off controlled, so that each time energy is stored in the energy storage coil 52 when the charge switch signal SWc is on, the stored energy is inputted to the ground side of the primary coil 41. In this case, the ignition apparatus 30 may optionally not include the capacitor 56.

(2) The blow-off detection unit 49 of the first embodiment determines, when the secondary electric current I2 detected by the secondary electric current detection circuit 48 drops below the blow-off detection electric current threshold value Ibo, that blow-off has occurred. Alternatively, the "blow-off detection means" of the present invention may detect occurrence of blow-off based on other parameters such as ion current.

In the case where the secondary electric current I2 is not used in the blow-off detection and not feedback controlled (for example, feed-forward controlled), the ignition apparatus 30 may not include the secondary electric current detection resistor 47 and the secondary electric current detection circuit 48.

(3) The blow-off detection unit 49 is not limited to the configuration of being included in the ignition circuit unit 31 as in the first embodiment. Instead, the blow-off detection unit 49 may be included in the electronic control unit 32. Moreover, the blow-off detection unit 49 may be constituted by either hardware or software.

(4) The ignition circuit unit 31 may be received in either a housing that receives the electronic control unit 32 or a housing that receives the ignition coil 40.

The ignition switch 45 and the energy input unit 50 may be respectively received in two different housings. For example, the ignition switch 45 may be received in the housing that receives the ignition coil 40, while the energy input unit 50 is received in the housing that receives the electronic control unit 32.

(5) The ignition switch is not limited to an IGBT. Instead, the ignition switch may be constituted of other switching elements having a relatively high withstand voltage. Moreover, the charge switch and the discharge switch are not limited to MOSFETs. Instead, the charge switch and the discharge switch may be constituted of other switching elements.

(6) The DC power supply is not limited to a battery. Instead, the DC power supply may be constituted of a stabilized DC power supply that is realized by, for example, stabilizing an AC power supply using a switching regulator.

(7) In the first embodiment, the energy input unit 50 boosts the voltage of the battery 6 using the DC-to-DC converter 51. Alternatively, in the case where the ignition apparatus is used in a hybrid vehicle or an electric vehicle, the output voltage of a main-machine battery may be used, as the input energy, either directly or via a voltage step-down.

(8) The electronic control unit 32 includes, in addition to the part mainly controlling the ignition apparatus 30, other parts controlling the operating state of the entire engine 13 which are relatively less relevant to the characteristics of the first embodiment. Those parts may be configured either as a single unit or as a plurality of separate units that communicate with each other via, for example, signal wires.

Second Embodiment

As the ignition apparatus according to the first embodiment, an ignition apparatus according to a second embodiment of the present invention is also applied to the engine system shown in FIG. 1.

Hereinafter, the configuration of the ignition apparatus 30 according to the second embodiment will be described with reference to FIG. 7.

Figure 7:
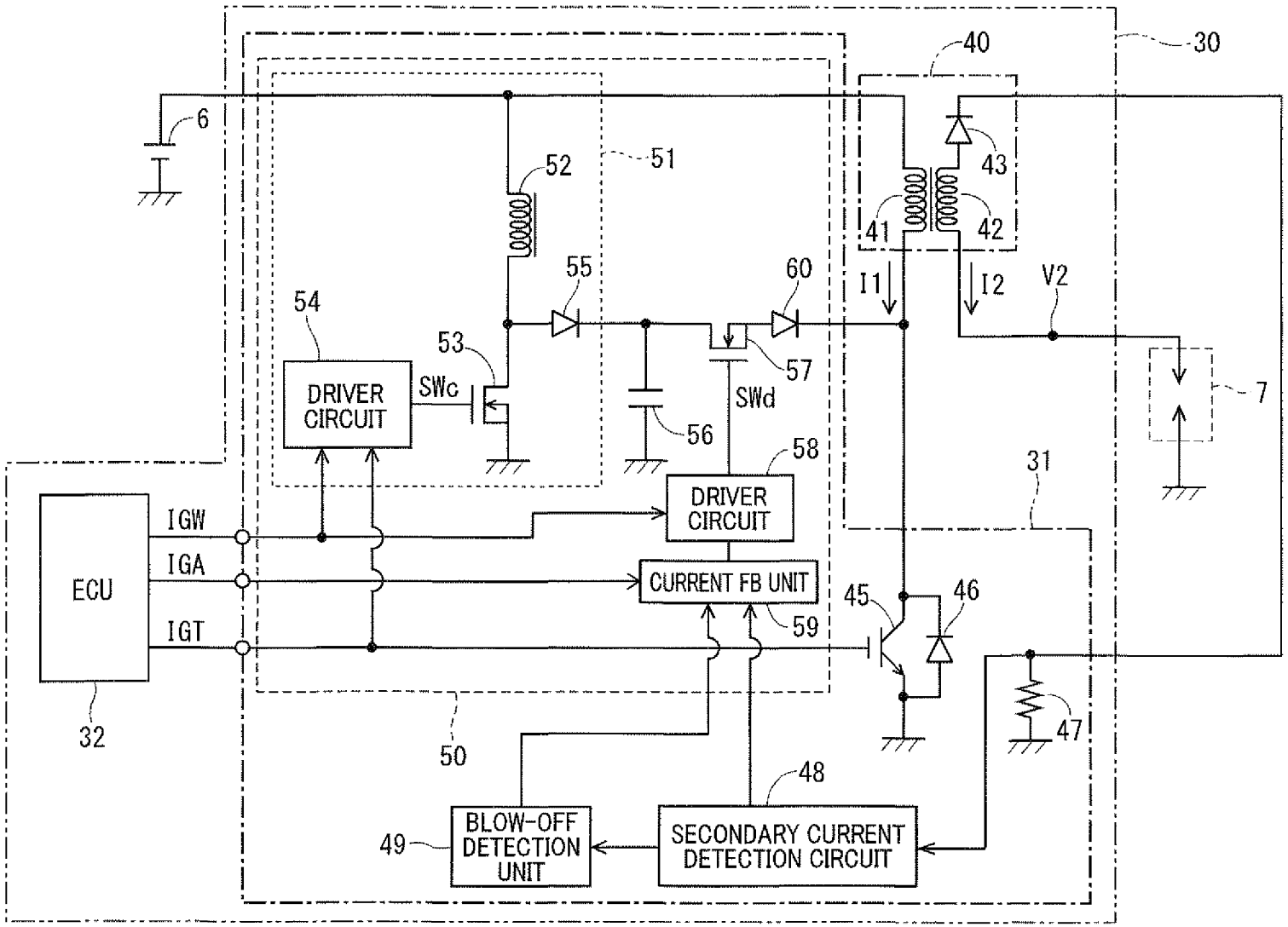
FIG. 7 is a configuration diagram of an ignition apparatus according to a second embodiment of the present invention.

As shown in FIG. 7, the ignition apparatus 30 includes an ignition coil 40, an ignition circuit unit 31 and an electronic control unit 32.

The ignition coil 40 includes a primary coil 41, a secondary coil 42 and a rectifying element 43. The ignition coil 40 constitutes a publicly-known booster transformer.

The primary coil 41 has one end connected to a positive terminal of a battery 6 which is a "DC power supply" capable of supplying a constant DC voltage, and the other end grounded via an ignition switch 45. Hereinafter, the opposite side of the primary coil 41 to the battery 6 will be referred to as "ground side".

The secondary coil 42 is magnetically coupled with the primary coil 41. The secondary coil 42 has one end grounded via the pair of electrodes of the ignition plug 7 and the other end grounded via the rectifying element 43 and a secondary electric current detection resistor 47.

The electric current flowing in the primary coil 41 will be referred to as primary electric current I1. The electric current which is generated by increase/decrease of the primary electric current I1 and flows in the secondary coil 42 will be referred to as secondary electric current I2. As shown with arrows in the figure, the primary electric current I1 is defined to be positive when flowing in the direction from the primary coil 41 to the ignition switch 45; the secondary electric current I2 is defined to be positive when flowing in the direction from the secondary coil 42 to the ignition plug 7. Moreover, the voltage on the ignition plug 7 side of the secondary coil 42 will be referred to as secondary voltage V2.

The rectifying element 43 is constituted of a diode. The rectifying element 43 rectifies the secondary electric current I2.

The ignition coil 40 generates a high voltage in the secondary coil 42 by the mutual inductive action of electromagnetic induction according to change in the electric current flowing in the primary coil 41, and applies the high voltage to the ignition plug 7. In the present embodiment, one ignition coil 40 is provided per ignition plug 7.

The ignition circuit unit 31 includes the ignition switch (igniter) 45, the secondary electric current detection resistor 47 and a secondary electric current detection circuit 48. Moreover, the ignition circuit unit 31 includes a blow-off detection unit 49 and an energy input unit 50, which are a characteristic configuration of the present invention.

The ignition switch 45 is constituted, for example, of an IGBT (Insulated Gate Bipolar Transistor). The ignition switch 45 has its collector connected to the ground side of the primary coil 41 of the ignition coil 40, its emitter grounded and its gate connected to the electronic control unit 32. The emitter is connected to the collector via a rectifying element 46.

The ignition switch 45 is on/off operated according to an ignition signal IGT inputted to the gate. Specifically, the ignition switch 45 is turned on when the ignition signal IGT rises and off when the ignition signal IGT falls. The supply and interruption of the primary electric current I1 flowing in the primary coil 41 is switched by the ignition switch 45 according to the ignition signal IGT.

The secondary electric current detection circuit 48 detects the secondary electric current I2 based on the voltage between two ends of the secondary electric current detection resistor 47.

The secondary electric current detection circuit 48 detects the secondary electric current I2 based on the voltage between the two ends of the secondary electric current detection resistor 47, and inputs the detected secondary electric current I2 to an electric current feedback control unit 59 of the energy input unit 50.

The energy input unit 50, as an "energy input means", includes a DC-to-DC converter 51, a capacitor 56, a discharge switch 57, a discharge switch driver circuit 58, the electric current feedback control unit 59 and a rectifying element 60. The DC-to-DC converter 51 is configured with an energy storage coil 52, a charge switch 53, a charge switch driver circuit 54 and a rectifying element 55. In addition, in FIG. 7, the electric current feedback control unit 59 is denoted by "current FB unit".

The DC-to-DC converter 51 boosts the voltage of the battery 6 and supplies it to the capacitor 56.

The energy storage coil 52 has one end connected to the battery 6 and the other end grounded via the charge switch 53. The charge switch 53 is constituted, for example, of a MOSFET (Metal Oxide Semiconductor Field Effect Transistor). The charge switch 53 has its drain connected to the energy storage coil 52, its source grounded and its gate connected to the charge switch driver circuit 54. The charge switch driver circuit 54 is capable of on/off driving the charge switch 53.

The rectifying element 55 is constituted of a diode. The rectifying element 55 prevents electric current from flowing from the capacitor 56 back to the side of the energy storage coil 52 and the charge switch 53.

Upon the charge switch 53 being turned on, electric current flows in the energy storage coil 52 and thus electrical energy is stored therein. Moreover, upon the charge switch 53 being turned off, the electrical energy stored in the energy storage coil 52 is superimposed on the DC voltage of the battery 6 and discharged to the capacitor 56 side. With the repeated on/off operation of the charge switch 53, the storage and discharge of energy is repeated in the energy storage coil 52, thereby boosting the battery voltage.

The capacitor 56 has one electrode connected to the ground side of the energy storage coil 52 via the rectifying element 55 and the other electrode grounded. The capacitor 56 stores the voltage boosted by the DC-to-DC converter 51.

The discharge switch 57 is constituted, for example, of a MOSFET. The discharge switch 57 has its drain connected to the capacitor 56, its source connected to the ground side of the primary coil 41 and its gate connected to the discharge switch driver circuit 58. The discharge switch driver circuit 58 is capable of on/off driving the discharge switch 57.

The electric current feedback control unit 59, as an "input energy control means", calculates an on-duty ratio of the discharge switch 57 and outputs a command signal to the discharge switch driver circuit 58, by a feedback control for bringing the secondary electric current I2 into agreement with a target value (to be referred to as "target secondary electric current I2*" hereinafter). As a result, the electric current feedback control unit 59 can control the energy input quantity inputted by the energy input unit 50. The target secondary electric current I2* is set based on a target secondary electric current signal IGA outputted from the ECU 32, and increase/decrease corrected according to the output from the blow-off detection unit 49.

The rectifying element 60 is constituted of a diode. The rectifying element 60 prevents electric current from flowing from the ignition coil 40 back to the capacitor 56.

The blow-off detection unit 49, as a "blow-off detection means", detects that after the start of a discharge by the ignition plug 7, the so-called "blow-off" has occurred which is a phenomenon where the discharge state is interrupted. More particularly, in the present embodiment, during the energy input period IGW, the blow-off detection unit 49 compares the secondary electric current I2 detected by the secondary electric current detection circuit 48 with a blow-off detection electric current threshold value Ibo and detects the dropping of the secondary electric current I2 below the blow-off detection electric current threshold value Ibo as blow-off.

The detection of blow-off described hereinafter denotes the detection, with the value of the secondary electric current I2, of a state where the discharged spark is about to be blown off, and is not limited to that the discharged spark has actually been blown off.

To detect blow-off, the blow-off detection electric current threshold value Ibo is set to a value just before occurrence of blow-off, which is close to zero. Moreover, the blow-off detection electric current threshold value Ibo may be either set to a fixed value or varied according to the operating condition of the engine 13.

Moreover, the blow-off detection unit 49 is capable of counting blow-off once each time blow-off has been detected during the energy input period IGW and storing the number of times of blow-off m. Furthermore, the blow-off detection unit 49 is also capable of counting non-detection once each time blow-off has not been detected in checking whether or not blow-off has occurred during the energy input period IGW and storing the number of times of non-detection n.

The above is the configuration of the ignition circuit unit 31.

In addition, in FIG. 7, there is shown only the configuration for one cylinder. However, in practice, the configuration after the discharge switch 57 is provided in the same number as the cylinders in parallel; the electric current path is branched for each cylinder before the discharge switch 57; and the energy stored in the capacitor 56 is distributed to each path.

Next, the electronic control unit 32 generates, based on the operating information of the engine 13 acquired from the various sensors such as the crank angle sensor 35, the ignition signal IGT, an energy input period signal IGW and the target secondary electric current signal IGA and outputs them to the ignition circuit unit 31.

The ignition signal IGT is inputted to the gate of the ignition switch 45 and the charge switch driver circuit 54. The ignition switch 45 is kept on for a time period for which the ignition signal IGT is kept at a H (High) level. The charge switch driver circuit 54 repeatedly outputs, for the time period for which the ignition signal IGT is kept at the H level, a charge switch signal SWc for on/off controlling the charge switch 53 to the gate of the charge switch 53.

The energy input period signal IGW is inputted to the discharge switch driver circuit 58. The discharge switch driver circuit 58 repeatedly outputs, for a time period for which the energy input period signal IGW is kept at a H level, a discharge switch signal SWd for on/off controlling the discharge switch 57 to the gate of the discharge switch 57. In the present embodiment, the time period for which the energy input period signal IGW is kept at the H level corresponds to the "energy input period".

The target secondary electric current signal IGA, which is a signal for commanding the target secondary electric current I2*, is inputted to the electric current feedback control unit 59.

Next, the operation of the ignition apparatus 30 according to the present embodiment will be described with reference to the time chart of FIG. 8.

In addition, there are the following two methods of changing the electric current flowing in the primary coil 41 for generating a high voltage in the secondary coil 42. The first method is to interrupt the supply of electric current from the battery 6 to the primary coil 41 by the ignition switch 45. The second method is to input energy from the ground side of the primary coil 41 by the energy input unit 50.

The operation of the ignition apparatus 30 described hereinafter is based on a control method that starts a discharge of the ignition plug 7 using the first method and then sustains the discharge using the second method. The control method has been developed by the present applicant. Hereinafter, in the present specification, "energy input control" denotes this control method. Here, an overview of the operation by the basic energy input control is first given and then the characteristics of the present embodiment will be described in detail later.

Figure 8:
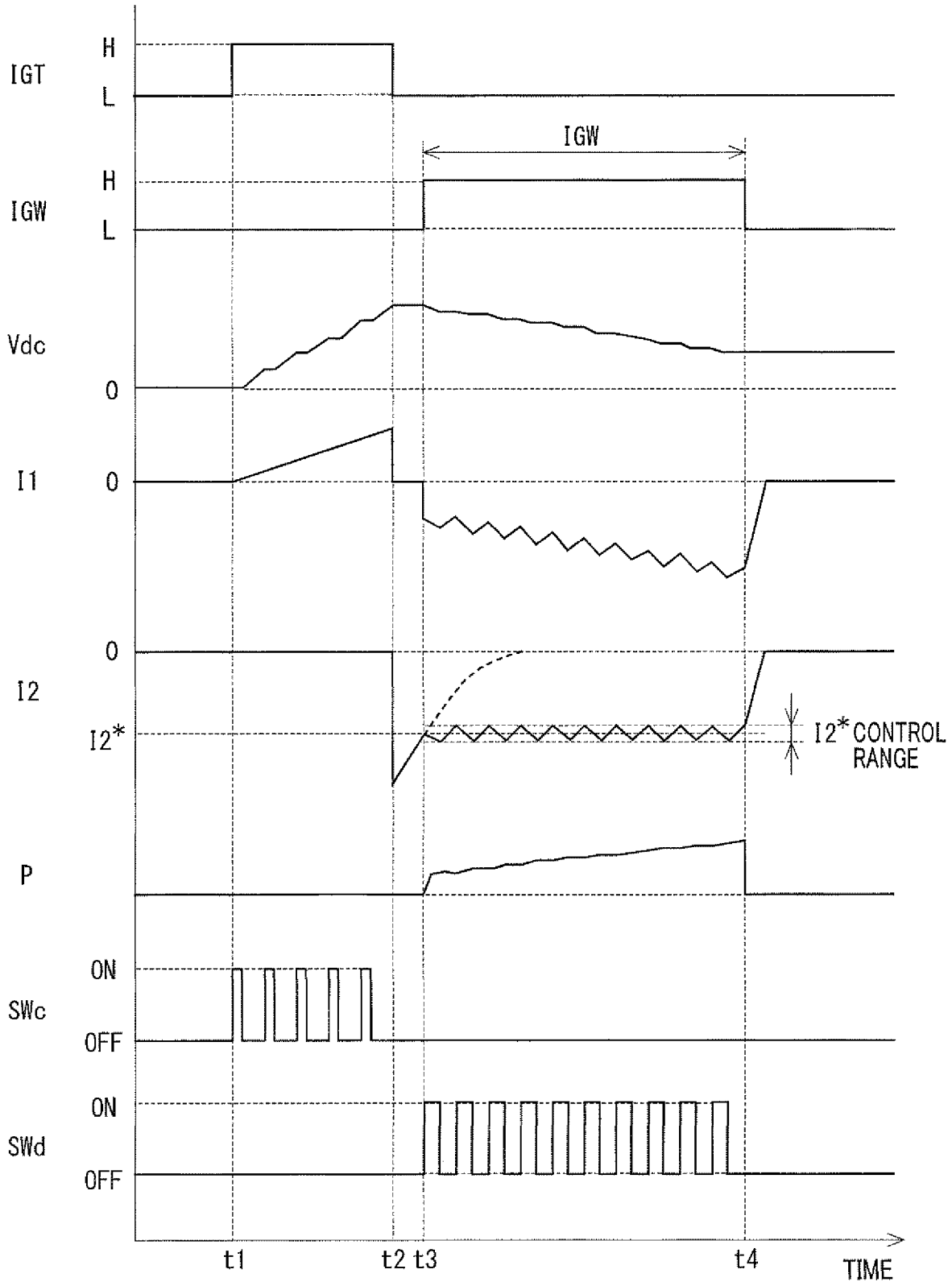
FIG. 8 is a time chart illustrating the basic operation of the ignition apparatus of FIG. 7.

The time chart of FIG. 8 shows, with the lateral axis being a common time axis, the changes with time of the ignition signal IGT, the energy input period signal IGW, a capacitor voltage Vdc, the primary electric current I1, the secondary electric current I2, an input energy P, the charge switch signal SWc and the discharge switch signal SWd on the vertical axis sequentially from the upper side.

Here, the "capacitor voltage Vdc" denotes the voltage stored in the capacitor 56. Moreover, the "input energy P" denotes the energy which is discharged from the capacitor 56 and supplied to the ignition coil 40 from a low voltage-side terminal of the primary coil 41; the "input energy P" indicates an integrated value from the supply start (the first rising of the discharge switch signal SWd) for one ignition timing.

In FIG. 8, "primary electric current I1" and "secondary electric current I2" are defined to be positive when flowing in the directions of arrows shown in FIG. 7 and negative when flowing in the opposite directions to the arrows. In the explanation given hereinafter, when the magnitude of a negative electric current is mentioned, the magnitude is indicated based on "the absolute value of the electric current". That is, in a negative region, when the electric current value moves away from 0 (A) and thus the absolute value increases, it is expressed as "the electric current increases or rises"; when the electric current value approaches 0 (A) and thus the absolute value decreases, it is expressed as "the electric current decreases or drops". Furthermore, in the comparison of the secondary electric current I2 with a negative threshold value to be described later, "the secondary electric current I2 drops below the threshold value" denotes "the absolute value of the secondary electric current I2 drops below the threshold value".

Upon the rising of the ignition signal IGT to the H level at a time instant t1, the ignition switch 45 is turned on. At this time, since the energy input period signal IGW is at a L (Low) level, the discharge switch 57 is kept off. Consequently, supply of the primary electric current I1 to the primary coil 41 is started.

Moreover, during the time period for which the ignition signal IGT is kept at the H level, the charge switch signal SWc in the form of a rectangular-wave pulse is inputted to the gate of the charge switch 53. Then, the capacitor voltage Vdc rises stepwise during each off-period after one on-period of the charge switch 53.

In this way, during the time period from the time instant t1 to a time instant t2, for which the ignition signal IGT is kept at the H level, the ignition coil 40 is charged and energy is stored in the capacitor 56 by the output of the DC-to-DC converter 51. The storage of energy is ended until the time instant t2.

At this time, the capacitor voltage Vdc, i.e., the energy storage quantity in the capacitor 56 can be controlled by the on-duty ratio and the number of times of on/off switching of the charge switch signal SWc.

Thereafter, when the ignition signal IGT is lowered to the L level at the time instant t2 and thus the ignition switch 45 is turned off, the primary electric current I1 having been supplied to the primary coil 41 is suddenly interrupted. Then, a large electromotive force is generated in the primary coil 41 by the battery 6 and thus a high secondary voltage is generated in the secondary coil 42. Consequently, a high voltage is applied from the ignition coil 40 to the ignition plug 7, so that a discharge occurs in the ignition plug 7 and the secondary electric current flows.

Thereafter, if the energy input control was not performed, the secondary electric current I2 would approach 0 (A) with the elapse of time, as shown with a dashed line. The discharge is ended when the secondary electric current I2 has attenuated to such a degree that it is impossible to sustain the discharge.

In the basic energy input control of the present embodiment, the energy input period signal IGW is raised to the H level at the time instant t3 immediately after the time instant t2, and the discharge switch signal SWd in the form of a rectangular-wave pulse is inputted to the discharge switch 57 with the charge switch signal SWc kept off. Consequently, the discharge switch 57 is repeatedly turned on/off with the charge switch 53 kept off.

Then, during the on-periods of the discharge switch 57, the stored energy of the capacitor 56 is discharged and inputted to the ground side of the primary coil 41. Consequently, the primary electric current I1 caused by the input energy P is supplied to the primary coil 41. Further, when the primary electric current I1 is supplied from the ground side of the primary coil 41 by the input energy P, on the secondary electric current I2 supplied by the interruption of the primary electric current I1, there is superimposed in the same polarity an additional secondary electric current I2 which is generated with the supply of the primary electric current I1 caused by the input energy P. When the secondary electric current I2 has increased to a predetermined value, the discharge switch 57 is turned off and thus the supply of the primary electric current I1 to the primary coil 41 is stopped, causing the secondary electric current I2 to decrease. Then, when the secondary electric current I2 has decreased to a predetermined value, the discharge switch 57 is again turned on and thus electric current is superimposed on the secondary electric current I2. The superimposition is repeated each time the discharge switch 57 is turned on during the time period from the time instant t3 to a time instant t4. Consequently, the secondary electric current I2 is kept in agreement with the target secondary electric current I2*.

In addition, hereinafter, the time period for which the energy input period signal IGW is kept at the H level, i.e., the time period for which the discharge is sustained by the energy input will be expressed as "energy input period IGW" using the same reference sign. Moreover, in the present embodiment, the target secondary electric current I2* is set to a middle value between maximum and minimum values of the wave shape of the secondary electric current I2 during the energy input period IGW. However, the target secondary electric current I2* may also be set to the maximum value or the minimum value.

Upon the energy input period signal IGW being lowered to the L level at the time instant t4, the discharge switch signal SWd is switched off and thus the on/off operation of the discharge switch 57 is stopped. Consequently, both the primary electric current I1 and the secondary electric current I2 become zero.

The ignition apparatus 30 of the present embodiment is assumed to be applied to a lean-burn engine that creates a strong gas flow in a combustion chamber 17 and thereby improves the combustibility. In such an engine, the discharge is extended by the gas flow. When the gas flow is strong, blow-off of the discharge may occur, repeating re-discharge and blow-off. Moreover, occurrence of blow-off is related not only with the strength of the gas flow in the combustion chamber, but also with the combustion state which depends on differences between individual engines 13, variation among cylinders and age deterioration. Therefore, the situation of occurrence of blow-off is not always the same. Hence, to suppress blow-off and re-discharge without consuming extra energy, it is necessary to adjust the energy input quantity by the energy input unit 50 according to the situation of occurrence of blow-off.

Accordingly, the blow-off detection unit 49 of the ignition apparatus 30 of the present embodiment detects occurrence of blow-off during the energy input period IGW based on the secondary electric current I2 detected by the secondary electric current detection circuit 48. Moreover, when occurrence of blow-off has been detected a predetermined number of times during the energy input period IGW, the target secondary electric current I2* of the electric current feedback control unit 59 is instantly corrected during the energy input period IGW so as to be increased. On the other hand, when non-detection of blow-off has continued for the energy input period IGW, i.e., when the discharged spark has continued without being blown off, the target secondary electric current I2* of the electric current feedback control unit 59 is corrected for the next ignition so as to be decreased. Consequently, blow-off is suppressed without excessive or deficient energy consumption.

Hereinafter, a blow-off detection process according to the present embodiment will be descried with reference to the flow chart of FIG. 9.

Figure 9:
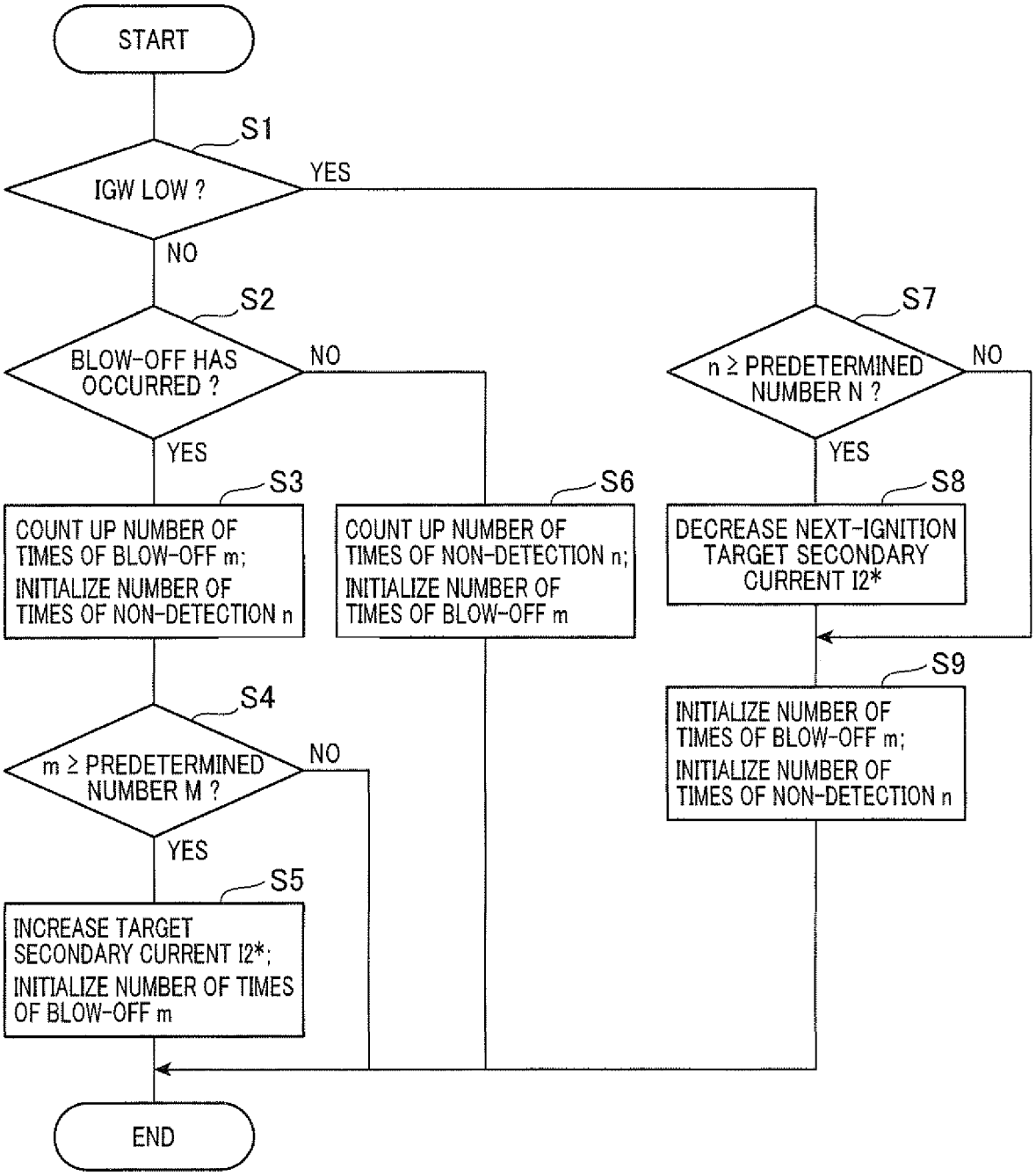
FIG. 9 is a flow chart illustrating a blow-off detection process.

The blow-off detection process shown in FIG. 9 is repeatedly performed, in each combustion cycle of the engine 13, after the energy input period signal IGW is switched to the H level and thus the energy input period IGW is started. Moreover, the initial values of the number of times of blow-off m and the number of times of non-detection n are set to zero; from the second cycle of the process, those values which were increased or decreased in the previous cycle are used.

In the explanation of the flow chart given hereinafter, the reference sign "S" denotes step.

First, at S1, the blow-off detection unit 49 determines whether or not the energy input period signal IGW is currently at the L level. If the energy input period signal IGW is determined to be not at the L level (S1: NO), the process proceeds to S2 as the energy input period IGW continues. Otherwise, if the energy input period signal IGW is determined to be at the L level (S1: YES), the process proceeds to S7 as the energy input period IGW is ended.

At S2, the blow-off detection unit 49 acquires the secondary electric current I2 during the energy input period IGW from the secondary electric current detection circuit 48, and determines whether or not the acquired secondary electric current I2 has dropped below the blow-off detection electric current threshold value Ibo. If the secondary electric current I2 is determined to have dropped below the blow-off detection electric current threshold value Ibo (S2: YES), the process proceeds to S3. Otherwise, if the secondary electric current I2 is determined to be higher than or equal to the blow-off detection electric current threshold value Ibo (S2: NO), the process proceeds to S6.

At S3, the blow-off detection unit 49 determines that blow-off has occurred during the energy input period IGW, counts up the number of times of blow-off m and initializes the number of times of non-detection. Then, the process proceeds to S4.

At S4, the blow-off detection unit 49 determines whether or not the number of times of blow-off m is greater than or equal to a predetermined number M. The predetermined number M is, for example, an arbitrary value which is set as a reference of determination as to whether or not the input energy to the ignition coil 40 is insufficient. If the number of times of blow-off m is determined to be greater than or equal to the predetermined number M (S4: YES), the process proceeds to S5. Otherwise, if the number of times of blow-off m is determined to be less than the predetermined number M (S4: NO), the process is directly ended.

At S5, the blow-off detection unit 49 performs a correction for increasing the target secondary electric current I2* of the electric current feedback control unit 59, and initializes the number of times of blow-off m. Then, the process is ended.

On the other hand, at S6 to which the process proceeds if the secondary electric current I2 is determined at S2 to be higher than or equal to the blow-off detection electric current threshold value Ibo (S2: NO), the blow-off detection unit 49 determines that blow-off has not occurred during the energy input period IGW, initializes the number of times of blow-off m, and counts up the number of times of non-detection n. Then, the process is ended.

Moreover, at S7 to which the process proceeds if the energy input period signal IGW is determined at S1 to be at the L level (S1: YES), the blow-off detection unit 49 further determines whether or not the number of times of non-detection n is greater than or equal to a predetermined number N. The predetermined number N is a value for determining that no blow-off has occurred for a predetermined time in the energy input period signal IGW. The predetermined number N is an arbitrary value which is preset as a reference of determination as to whether or not the input energy to the ignition coil 40 is redundant. For a stable ignition, it is preferable that M>N.

If the number of times of non-detection n is determined to be greater than or equal to N (S7: YES), the process proceeds to S8. At S8, the blow-off detection unit 49 performs a correction for decreasing the target secondary electric current I2* of the electric current feedback control unit 59 for the next ignition. Then, the process proceeds to S9.

Otherwise, if the number of times of non-detection n is determined to be less than the predetermined number N (S7: NO), the process directly proceeds to S9.

At S9, the blow-off detection unit 49 initializes both the number of times of blow-off m and the number of times of non-detection n. Then, the blow-off detection process is ended, and stopped until the next time the energy input period signal IGW is switched to the H level.

Figure 10:
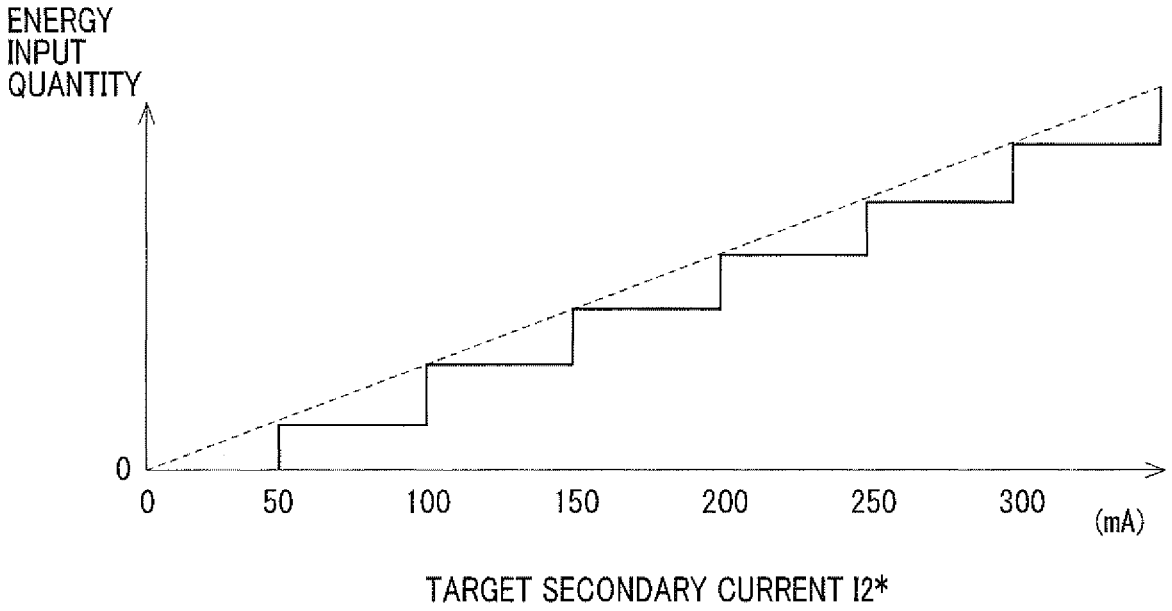
FIG. 10 is a graph showing the relationship between target secondary electric current and energy input quantity.

In addition, as the control method of increasing or decreasing the target secondary electric current I2*, as shown in FIG. 10, either a linear variable control (the dashed line in FIG. 10) or a digital variable control (the continuous line in FIG. 10) may be used. For example, in the case of using the digital variable control, the target secondary electric current I2* may be increased or decreased from the present value each time by one stage.

Here, increasing the target secondary electric current I2* is to increase the energy input quantity inputted by the energy input unit 50. Moreover, decreasing the target secondary electric current I2* is to decrease the energy input quantity inputted by the energy input unit 50. That is, in the present embodiment, the target secondary electric current I2* corresponds to the "energy input quantity".

Moreover, the above process is performed, as a general rule, on a cylinder basis. However, it is also possible to simplify the configuration and control a plurality of cylinders as a group. Moreover, it may be reflected to a learning control.

Figure 11:
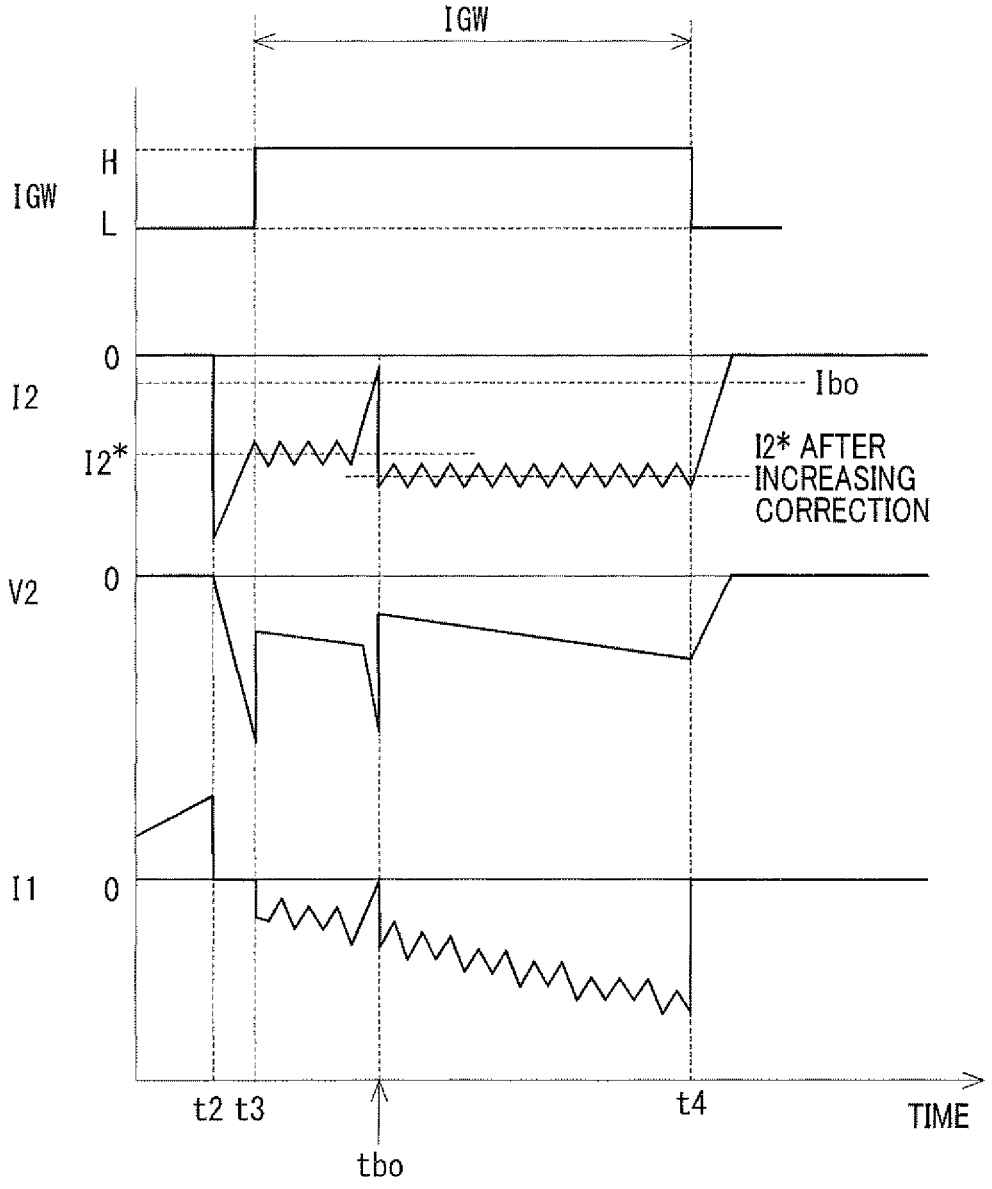
FIG. 11 is a time chart illustrating the operation when blow-off has occurred.

The secondary electric current I2 in the case of occurrence of blow-off is shown in FIG. 11. FIG. 11 shows, with the lateral axis being a common time axis, the energy input period signal IGW, the secondary electric current I2, the secondary voltage V2 and the primary electric current I1 on the vertical axis sequentially from the upper side.

Suppose that the secondary electric current I2 drops below the blow-off detection electric current threshold value Ibo at, for example, a time instant tbo during the supply of the primary electric current I1 in the energy input period IGW. The blow-off detection unit 49 of the present embodiment detects the drop of the secondary electric current I2 below the blow-off detection electric current threshold value Ibo as blow-off. For example, in the case where the predetermined number M is equal to 1, as shown in FIG. 11, the target secondary electric current I2* is instantly increased. Consequently, in the energy input period IGW the same as the energy input period IGW in which blow-off has been detected, the energy input quantity inputted by the energy input unit 50 is increased. Therefore, it is possible to strengthen the spark of a re-discharge after blow-off, thereby suppressing the repetition of blow-off and re-discharge.

In the second embodiment, it is possible to achieve the following advantageous effects.

(1) The ignition apparatus 30 of the second embodiment includes the blow-off detection unit 49 that detects blow-off of a discharge during the energy input period IGW. When blow-off has been continuously detected a predetermined number of times or more during the energy input period IGW, the blow-off detection unit 49 increases the target secondary electric current I2*. Consequently, the input energy is increased according to the situation of occurrence of blow-off; thus it is possible to suppress blow-off after a re-discharge that is caused by blow-off, without excessive or deficient energy consumption.

Moreover, when non-detection of blow-off has continued a predetermined number of times or more during the energy input period IGW, the blow-off detection unit 49 decreases the target secondary electric current I2* for the next energy input period IGW. The fact that non-detection has continued means that the ignition discharge has continued for a given time without occurrence of blow-off. In this case, by determining that the input energy is redundant and decreasing the input energy for the next energy input period IGW, it is possible to save energy consumption.

Moreover, using the above-described control combined with increase/decrease of the input energy, it is possible to perform the energy input control with the minimum energy input quantity required to prevent occurrence of blow-off.

As above, by performing the energy input control according to the situation of occurrence of blow-off, it is possible to automatically input the optimal energy according to the combustion state which depends on differences between individual internal combustion engines, variation among cylinders and age deterioration.

(2) The ignition apparatus 30 of the second embodiment includes the secondary electric current detection circuit 48 that detects the secondary electric current I2 during the energy input period IGW. When the absolute value of the secondary electric current I2 drops below the predetermined blow-off detection electric current threshold value Ibo, the blow-off detection unit 49 determines that blow-off has occurred. That is, the absolute value of the secondary electric current I2 rapidly drops upon occurrence of blow-off; therefore, it is possible to appropriately detect occurrence of blow-off by monitoring the absolute value of the secondary electric current I2.

Moreover, when the target secondary electric current I2* is changed by the blow-off detection unit 49, the electric current feedback control unit 59 accurately brings the actual value of the secondary electric current I2 into agreement with the target secondary electric current I2* by the feedback control based on the detected electric current. Consequently, it is possible to appropriately change the energy input quantity.

(3) In the ignition apparatus 30 of the second embodiment, as the energy input control method, there is used the method of inputting the input energy, which is boosted by the DC-to-DC converter 51 and stored in the capacitor 56, from the ground side of the primary coil 41. Consequently, compared to an energy input method such as multiple discharge, by inputting energy from the low-voltage side, it is possible to sustain an ignitable state for a given time period while efficiently inputting a minimum amount of energy.

Moreover, during the energy input period IGW, the secondary electric current I2 always takes a negative value and does not cross zero as in other methods that use alternating current; therefore, it is possible to prevent occurrence of blow-off.

Modifications of Second Embodiment (1) In the blow-off detection process of the second embodiment, the increasing correction of the target secondary electric current I2* is instantly reflected in the same energy input period IGW. However, the present invention is not limited to the above; the increasing correction of the target secondary electric current I2* may also be reflected in the energy input period IGW of the next ignition.

Moreover, the decreasing correction of the target secondary electric current I2* may be instantly reflected in the same energy input period IGW. In this case, S7 and S8 of FIG. 9 may also be performed after the process of S6, and the number of times of non-detection n may be initialized only when the target secondary electric current I2* is decreased.

Moreover, the blow-off detection unit 49 may output to the ECU 32 so as to perform a correction process, thereby directly changing the target secondary electric current signal IGA.

(2) In the blow-off detection process of the second embodiment, the number of times of blow-off m, which is used in determining whether or not occurrence of blow-off has been detected a predetermined number of times, is not limited to the number of continuously detected times. For example, the number of times of blow-off m may not be initialized in the case of non-detection of blow-off (S2: NO), and the determination at S4 may be made based on the accumulated number of times of detection of blow-off.

(3) In the second embodiment, an example is shown where the above blow-off detection process is repeatedly performed for the time period for which the energy input period signal IGW is kept at the H level. However, the above blow-off detection process may be terminated upon the increasing correction of the target secondary electric current I2*, or terminated after being repeated a predetermined number of times.

(4) The energy input unit 50 of the second embodiment uses the "method of inputting energy from the ground side of the primary coil", which has been developed by the present applicant. However, provided that it is possible to control the energy input quantity during a discharge period, other methods, such as the conventional multiple discharge method or a "DCO method" disclosed in Japanese Patent Application Publication No. JP2012167665A, may also be used as the "energy input means" of the present invention to perform a control of raising or lowering the coil power supply voltage according to the state of blow-off.

Moreover, in the energy input method shown in FIG. 8, during the time period for which the ignition signal IGT is kept at the H level, the capacitor voltage Vdc is stored by switching on/off the charge switch signal SWc; then, during the energy input period IGW, energy is inputted to the ground side of the primary coil 41. However, the energy input control by the ignition apparatus 30 having the configuration of FIG. 7 is not limited to the energy input method shown in FIG. 8. For example, during the energy input period IGW, the charge switch signal SWc and the discharge switch signal SWd may be alternately on/off controlled, so that each time energy is stored in the energy storage coil 52 when the charge switch signal SWc is on, the stored energy is inputted to the ground side of the primary coil 41. In this case, the ignition apparatus 30 may not include the capacitor 56.

(5) The blow-off detection unit 49 of the second embodiment determines, when the secondary electric current I2 detected by the secondary electric current detection circuit 48 drops below the blow-off detection electric current threshold value Ibo, that blow-off has occurred. Alternatively, the "blow-off detection means" of the present invention may detect occurrence of blow-off based on other parameters such as ion current.

In the case where the secondary electric current I2 is not used in the blow-off detection and not feedback controlled (for example, feed-forward controlled), the ignition apparatus 30 may not include the secondary electric current detection resistor 47 and the secondary electric current detection circuit 48.

(6) The blow-off detection unit 49 is not limited to the configuration of being included in the ignition circuit unit 31 as in the second embodiment. Instead, the blow-off detection unit 49 may be included in the electronic control unit 32. Moreover, the blow-off detection unit 49 may be constituted by either hardware or software.

(7) The ignition circuit unit 31 may be received in either a housing that receives the electronic control unit 32 or a housing that receives the ignition coil 40.

The ignition switch 45 and the energy input unit 50 may be respectively received in two different housings. For example, the ignition switch 45 may be received in the housing that receives the ignition coil 40, while the energy input unit 50 is received in the housing that receives the electronic control unit 32.

(8) The ignition switch is not limited to an IGBT. Instead, the ignition switch may be constituted of other switching elements having a relatively high withstand voltage. Moreover, the charge switch and the discharge switch are not limited to MOSFETs. Instead, the charge switch and the discharge switch may be constituted of other switching elements.

(9) The DC power supply is not limited to a battery. Instead, the DC power supply may be constituted of a stabilized DC power supply that is realized by, for example, stabilizing an AC power supply using a switching regulator.

(10) In the second embodiment, the energy input unit 50 boosts the voltage of the battery 6 using the DC-to-DC converter 51. Alternatively, in the case where the ignition apparatus is used in a hybrid vehicle or an electric vehicle, the output voltage of a main-machine battery may be used, as the input energy, either directly or via a voltage step-down.

(11) The electronic control unit 32 includes, in addition to the part mainly controlling the ignition apparatus 30, other parts controlling the operating state of the entire engine 13 which are relatively less relevant to the characteristics of the second embodiment. Those parts may be configured either as a single unit or as a plurality of separate units that communicate with each other via, for example, signal wires.

The present invention is not limited to the above-described embodiments and can be carried out in various modes without departing from the spirit of the invention.

DESCRIPTION OF REFERENCE SIGNS

13: internal combustion engine
17: combustion chamber
30: ignition apparatus
40: ignition coil
41: primary coil
42: secondary coil
45: ignition switch
49: blow-off detection unit (blow-off detection means)
50: energy input unit (energy input means)
59: electric current feedback control unit (input energy control means)
6: battery (DC power supply)
7: ignition plug

What is claimed is:

1. An ignition apparatus that controls operation of an ignition plug for igniting an air-fuel mixture in a combustion chamber of an internal combustion engine, the ignition apparatus comprising:

an ignition coil that includes a primary coil in which a primary electric current supplied from a DC power supply flows, and a secondary coil which is connected to an electrode of the ignition plug and in which a secondary voltage is generated by supply and interruption of the primary electric current and thus a secondary electric current flows;

an ignition switch that is connected to a ground side of the primary coil and switches the supply and interruption of the primary electric current according to an ignition signal, the ground side being an opposite side of the primary coil to the DC power supply;

an energy input means capable of inputting energy during a predetermined energy input period after the interruption of the primary electric current by the ignition switch and a discharge of the ignition plug caused by the secondary voltage due to the interruption; and a blow-off detection means that detects occurrence of blow-off of the discharge after the start of the discharge by the ignition plug, wherein the ignition apparatus continues the energy input by the energy input means when occurrence of blow-off is detected by the blow-off detection means in a first region, the first region being a time region from the start of the energy input period and in which a re-discharge after blow-off of the ignition plug is possible.

2. The ignition apparatus as set forth in claim 1, further comprising a secondary electric current detection means that detects the secondary electric current, wherein during the energy input period, the energy input means controls the energy input to the primary coil based on the secondary electric current detected by the secondary electric current detection means.

3. The ignition apparatus as set forth in claim 2, wherein the ignition apparatus stops the energy input by the energy input means when occurrence of blow-off is detected by the blow-off detection means in a second region after the first region.

4. The ignition apparatus as set forth in claim 2, wherein when an absolute value of the secondary electric current drops below a predetermined blow-off detection electric current threshold value, the blow-off detection means determines that blow-off has occurred.

5. The ignition apparatus as set forth in claim 1, wherein the energy input means is capable of inputting energy from the ground side of the primary coil in the same polarity as the secondary electric current and in a superimposing manner.

* * * * *